US009814361B2

(12) United States Patent
Bilger et al.

(10) Patent No.: US 9,814,361 B2
(45) Date of Patent: Nov. 14, 2017

(54) SURFACE CLEANING APPARATUS

(71) Applicant: Euro-Pro Operating LLC, Newton, MA (US)

(72) Inventors: Dan Bilger, Amherst, NH (US); Susan Rifkin St. Amand, Franklin, MA (US)

(73) Assignee: SharkNinja Operating LLC, Needham, MA (US)

( * ) Notice: Subject to any disclaimer, the term of this patent is extended or adjusted under 35 U.S.C. 154(b) by 332 days.

(21) Appl. No.: 14/383,474

(22) PCT Filed: Mar. 8, 2013

(86) PCT No.: PCT/US2013/029862
§ 371 (c)(1),
(2) Date: Sep. 5, 2014

(87) PCT Pub. No.: WO2013/134637
PCT Pub. Date: Sep. 12, 2013

(65) Prior Publication Data

US 2015/0040340 A1 Feb. 12, 2015

Related U.S. Application Data

(60) Provisional application No. 61/608,919, filed on Mar. 9, 2012.

(51) Int. Cl.
*A47L 5/28* (2006.01)
*A47L 5/22* (2006.01)
(Continued)

(52) U.S. Cl.
CPC ..... *A47L 5/28* (2013.01); *A47L 5/225* (2013.01); *A47L 9/165* (2013.01); *A47L 9/1683* (2013.01); *A47L 9/242* (2013.01)

(58) Field of Classification Search
CPC ... A47L 5/225; A47L 5/28; A47L 9/16; A47L 9/242; A47L 9/165; A47L 9/1683
See application file for complete search history.

(56) References Cited

U.S. PATENT DOCUMENTS 5,078,761 A 1/1992 Dyson
7,937,802 B2 5/2011 Yoo et al.
(Continued)

FOREIGN PATENT DOCUMENTS

WO WO 2009/026709 3/2009

OTHER PUBLICATIONS

EPO Search Report dated Feb. 16, 2016, received in corresponding EP Application No. 13757671.6, 7 pgs.
(Continued)

*Primary Examiner* — Robert Scruggs
(74) *Attorney, Agent, or Firm* — Grossman Tucker Perreault & Pfleger, PLLC

(57) ABSTRACT

An upright surface cleaning apparatus may include a surface cleaning head, a flexible conduit section and an upper section movably mounted to the cleaning head. The upper section may include an air treatment member positioned in the air flow passage between the dirty air inlet and the clean air outlet, The surface cleaning apparatus may also include a suction motor positioned in the air flow passage. The upper section may also include an upflow conduit positioned in the air flow passage between the flexible conduit section and the air treatment member. When the upper section is in the upright position, the flexible conduit may include a portion that extends downwardly to a downstream end of the flexible conduit and the upflow conduit may extend upwardly from an upstream end of the upflow conduit to a downstream end of the upflow conduit.

21 Claims, 17 Drawing Sheets

(51) Int. Cl.
*A47L 9/16* (2006.01)
*A47L 9/24* (2006.01)

(56) References Cited

U.S. PATENT DOCUMENTS

| | | | | |
|---|---|---|---|---|
| 8,032,983 | B2 | 10/2011 | Griffith et al. | |
| 2008/0178420 | A1* | 7/2008 | Conrad | A47L 5/225 15/410 |
| 2011/0219567 | A1 | 9/2011 | Conrad | |
| 2011/0219568 | A1* | 9/2011 | Conrad | A47L 5/225 15/331 |
| 2011/0219572 | A1 | 9/2011 | Conrad | |
| 2011/0219579 | A1 | 9/2011 | Conrad | |

OTHER PUBLICATIONS

International Search Report and Written Opinion for PCT/US2013/029862 dated Jun. 21, 2013.
International Preliminary Report on Patentability for PCT/US2013/029862 dated Sep. 18, 2014.
Korean Office Action dated Nov. 23, 2016, with English language translation, received in corresponding Korean Application No. 20-2014-7000047, 14 pgs.

* cited by examiner

SURFACE CLEANING APPARATUS

RELATED APPLICATIONS

The present application is a national stage filing under 35 U.S.C. §371 of international PCT application PCT/US2013/029862, filed Mar. 8, 2013, and entitled "SURFACE CLEANING APPARATUS," which claims priority under 35 USC §119(e) priority to U.S. Provisional Patent Application Ser. No. 61/608,919, filed Mar. 9, 2012, and entitled "SURFACE CLEANING APPARATUS," each of which is incorporated herein by reference in its entirety.

FIELD

The present subject matter of the teachings described herein relates generally to surface cleaning apparatuses, such as vacuum cleaners.

BACKGROUND

Various constructions for surface cleaning apparatuses, such as vacuum cleaners, are known. Currently, many surface cleaning apparatuses are constructed using at least one cyclonic cleaning stage. Air is drawn into the vacuum cleaners through a dirty air inlet and conveyed to a cyclone inlet. The rotation of the air in the cyclone results in some of the particulate matter in the airflow stream being disentrained from the airflow stream. This material is then collected in a dirt bin collection chamber, which may be at the bottom of the cyclone or in a direct collection chamber exterior to the cyclone chamber (see for example WO2009/026709 and U.S. Pat. No. 5,078,761). One or more additional cyclonic cleaning stages and/or filters may be positioned downstream from the cyclone.

SUMMARY

The following summary is provided to introduce the reader to the more detailed discussion to follow. The summary is not intended to limit or define the claims.

According to one broad aspect of the teachings described herein, a surface cleaning apparatus includes a surface cleaning head and an upper section mounted to the surface cleaning head. The surface cleaning apparatus includes a dirty air inlet, a clean air outlet and an air flow passage that extends therebetween. A suction motor and an air treatment member can be provided in the air flow passage between the dirty air inlet and the clean air outlet. The upper section may be moveable between an upright position and an in use position. Optionally, the upper section can be detachable from the surface cleaning head.

The air flow passage may include a first upflow conduit in air flow communication with the dirty air inlet, a second upflow conduit in air flow communication with the air treatment member, and a downflow conduit in air flow communication between the first and second upflow conduits. A portion of the first upflow conduit may include a detachable cleaning wand, and may be operable in both a surface cleaning mode and an above floor cleaning mode. Preferably, the downflow conduit includes a flexible hose member that fluidly connects the cleaning wand to the air flow passage. The flexible hose may allow a user to manipulate the cleaning wand separately from the upper section. When a user moves the cleaning wand, the flexible hose may exert a pulling force on the upper section.

Preferably, an upstream end of the second upflow conduit is positioned relatively low on the upper section, and more preferably is positioned proximate the lower end of the upper section. The downstream end of the downflow conduit may be coupled to the upstream end of the second upflow conduit and may also be provided proximate the lower end of the upper section.

An advantage of this configuration may be that forces transferred from the flexible hose to the upper section are exerted toward the lower end of the upper section. This may help reduce the likelihood that surface cleaning apparatus will tip over if a user pulls on the hose. This may help allow the surface cleaning apparatus, or portions thereof, to be pulled along behind a user when the user is using the cleaning wand, instead of falling over.

In accordance with this broad aspect, an upright surface cleaning apparatus may include a surface cleaning head having a dirty air inlet and an air flow passage extending from the dirty air inlet to a clean air outlet. The surface cleaning apparatus may include a flexible conduit section and an upper section movably mounted to the cleaning head that may be moveable between an upright position and a second inclined in use position. The upper section may include an air treatment member positioned in the air flow passage between the dirty air inlet and the clean air outlet. The surface cleaning apparatus may also include a suction motor positioned in the air flow passage. The upper section may also include an upflow conduit positioned in the air flow passage between the flexible conduit section and the air treatment member. When the upper section is in the upright position, the flexible conduit may include a portion that extends downwardly to a downstream end of the flexible conduit and the upflow conduit may extend upwardly from an upstream end of the upflow conduit to a downstream end of the upflow conduit.

When the upper section is in the upright position the upstream end of the upflow conduit may be positioned below the center of gravity of the surface cleaning apparatus and the downstream end of the upflow conduit may be above the center of gravity of the surface cleaning apparatus.

The upstream end of the upflow conduit may be at a level with the suction motor, and the suction motor may be disposed below the air treatment member at a lower end of the upright section.

The air treatment member may include an air inlet and when the upper section is in the upright position the upstream end of the upflow conduit may be below the air inlet of the cyclone chamber.

The surface cleaning apparatus may also include a rigid upflow conduit extending upwardly from an upstream end connected in air flow communication with the surface cleaning head to a downstream end positioned above the air treatment member when the upper section is in the upright position. The flexible conduit section may be positioned between the downstream end of the rigid upflow conduit and the upstream end of the upflow conduit.

The downstream end of the rigid upflow conduit may include a handle drivingly connected to the upper section.

The air treatment member may include a cyclone chamber and a dirt collection chamber disposed at least partially below the cyclone chamber to receive dirt from the cyclone chamber. The dirt collection chamber may have a bottom end wall and the upstream end of the upflow conduit may be below the bottom end wall of the dirt collection chamber when the upper section is in the upright position.

The downstream end of the flexible conduit may be rotatable relative to the upstream end of the upflow conduit.

The surface cleaning apparatus may also include a curved conduit member disposed between the flexible conduit and the upflow conduit and a rotatable coupling may be provided on at least one end of the curved conduit member.

The curved conduit member is rotatably coupled to at least one of the upstream end of the upflow conduit and the downstream end of the flexible conduit.

The inlet of the curved conduit member may be rotatably coupled to the downstream end of the flexible conduit. An outlet of the curved conduit member may be rotatably coupled to the upstream end of the upflow conduit.

The inlet and outlet of the curved conduit member may be oriented in different directions.

The upper section may include a cleaning unit and the cleaning unit may include at least the air treatment member.

The upflow conduit may be provided on the cleaning unit.

The upstream end of the upflow conduit may be positioned proximate the lower end of the cleaning unit.

The upstream end of the upflow conduit may be positioned below the center of gravity of the cleaning unit when the upper section is in the upright position.

The upstream end of the upflow conduit is proximate a lower end of the cleaning unit.

The downstream end of the upflow conduit may be positioned above the centre of gravity of the cleaning unit when the upper section is in the upright position.

The cleaning unit may also include the suction motor.

The upstream end of the upflow conduit may be positioned below the center of gravity of the suction motor when the upper section is in the upright position and may be positioned above the suction motor when the upper section is in the upright position.

The cleaning unit may have a cleaning unit height measured in the direction of a longitudinal cleaning unit axis and a longitudinal spacing between the upstream end of the upflow conduit and the downstream end of the upflow conduit may be between about 15% and about 100% of the upper section unit height.

The longitudinal spacing between the upstream end of the upflow conduit and the downstream end of the upflow conduit is between about 35% and about 85% of the upper section unit height.

The longitudinal spacing between the upstream end of the upflow conduit and the bottom of the cleaning unit may be less than about 25% of the upper section unit height.

The longitudinal spacing between the upstream end of the upflow conduit and the bottom of the cleaning unit may be less than about 10% of the upper section height.

The surface cleaning apparatus may also include a mounting hub movably coupled to the surface cleaning head and the cleaning unit may be detachably mounted to the mounting hub.

The cleaning unit may include at least one cleaning unit support member configured to support the cleaning unit when the cleaning unit is separated from the surface cleaning head.

The at least one cleaning unit support member may include at least one wheel.

The air treatment member may include a cyclone chamber having a cyclone air inlet in flow communication with the downstream end of the upflow conduit.

The air treatment member may include a cyclone bin assembly including the cyclone chamber and a dirt collection chamber.

The cyclone air inlet may be provided toward the bottom of the cyclone chamber.

The surface cleaning apparatus may include an above floor cleaning wand, the surface cleaning apparatus may be operable in a floor cleaning mode wherein the above floor cleaning wand forms a portion of the air flow passage and an above floor cleaning mode wherein an inlet of the above floor cleaning wand may be detached from air flow communication with the dirty air inlet. The above floor cleaning wand may have an outlet connected upstream from the flexible conduit section, The surface cleaning apparatus may include a handle connected to the above floor cleaning wand and the handle and above floor cleaning wand may be drivingly connected to the surface cleaning head when the surface cleaning apparatus is in the floor cleaning mode.

The handle may include a first grip member and a separate second grip member. The first grip member may extend in a first direction and the second grip member may extend in a second direction that is at an angle to the first direction.

The second grip member may be oriented at an angle between about 15 degrees and about 75 degrees relative to the first grip member.

When he surface cleaning apparatus is in the upright position the second grip member may be generally vertical and the first grip member is within about 30 degrees of horizontal.

The second grip may be provided on a front portion of the handle and may be generally vertical when the upper section is in the upright position.

The handle may be provided proximate the outlet of the cleaning wand.

The cleaning wand may have a wand length, the upflow conduit may have an upflow conduit length and the upflow conduit length may be at least 35% of the wand length.

The upflow conduit length may be at least 50% of the wand length.

The cleaning wand may be attached to the upper section and when the upper section is in the upright position, the inlet of the cleaning wand is positioned vertically between the upstream end and downstream end of the upflow conduit.

The upflow conduit may be inclined relative to the upper section so that the upstream end of the upflow conduit is spaced from the downstream end of the upflow conduit in the direction of motion of the surface cleaning apparatus.

An upright surface cleaning apparatus may include a surface cleaning head having a dirty air inlet and an air flow passage extending from the dirty air inlet to a clean air outlet. An upper section may be movably mounted to the surface cleaning head and may be moveable between an upright position and a second inclined in use position. The upper section may include an air treatment member positioned in the air flow passage between the dirty air inlet and the clean air outlet and a suction motor positioned in the air flow passage. When the upper section is in the upright position, the air flow passage may include a rigid first upflow conduit extending between an upstream end of the rigid first upflow conduit that is in fluid flow communication with the surface cleaning head and a downstream end of the rigid first upflow conduit that is positioned above the air treatment member, a second upflow conduit extending upwardly from an upstream end of the second upflow conduit that is positioned proximate a lower end of the upper section to a downstream end of the second upflow conduit that is positioned above the upstream end of the second upflow conduit, and a downflow conduit extending between the downstream end of the first upflow conduit and the upstream end of the second upflow conduit.

The downstream end of the second upflow conduit may be proximate an air inlet of the air treatment member.

The first upflow conduit, second upflow conduit and downflow conduit may be external the air treatment member.

When the upper section is in the upright position, the upstream end of the second upflow conduit may be positioned below the center of gravity of the surface cleaning apparatus.

When the upper section is in the upright position, the downstream end of the second upflow conduit may be positioned above the center of gravity of the surface cleaning apparatus.

At least one of the downflow conduit and the second upflow conduit may include a flexible hose.

The air treatment member may include an air inlet and when the upper section is in the upright position the upstream end of the second upflow conduit may be below the air inlet of the cyclone chamber.

The air treatment member may include a cyclone chamber and a dirt collection chamber disposed at least partially below the cyclone chamber to receive dirt from the cyclone chamber. The dirt collection chamber may have a bottom endwall and the upstream end of the second upflow conduit may be below the bottom endwall of the dirt collection chamber when the upper section is in the upright position.

A downstream end of the downflow conduit may be rotatable relative to the upstream end of the second upflow conduit.

The surface cleaning apparatus may also include a curved conduit member disposed between the downflow conduit and the second upflow conduit and a rotatable coupling may be provided an at least one end of the curved conduit member.

The curved conduit member may be rotatably coupled to at least one of the upstream end of the second upflow conduit and the downstream end of the downflow conduit.

The inlet and outlet of the curved conduit member may be oriented in different directions.

The upper section may include a cleaning unit and the cleaning unit may include the air treatment member.

The second upflow conduit may be provided on the cleaning unit.

The upstream end of the second upflow conduit may be proximate the lower end of the cleaning unit.

The upstream end of the second upflow conduit may be positioned below the center of gravity of the cleaning unit when the upper section is in the upright position.

The downstream end of the second upflow conduit may be positioned above the center of gravity of the cleaning unit when the upper section is in the upright position.

The cleaning unit may also include the suction motor.

The upstream end of the second upflow conduit may be positioned below the center of gravity of the suction motor, when the upper section is in the upright position.

The downstream end of the second upflow conduit may be positioned above the suction motor when the upper section is in at least one of the upright position and the second position.

The upper section may have an upper section height measured in the direction of a longitudinal cleaning unit axis and a longitudinal spacing between the upstream end of the second upflow conduit and the downstream end of the second upflow conduit may be between about 15% and about 100% of the upper section height.

The longitudinal spacing between the between the upstream end of the second upflow conduit and the downstream end of the second upflow conduit may be between about 25% and about 85% of the upper section height.

The longitudinal spacing between the upstream end of the second upflow conduit and the bottom of the cleaning unit may be less than about 25% of a cleaning unit height.

The longitudinal spacing between the upstream end of the second upflow conduit and the bottom of the cleaning unit may be less than about 10% of the cleaning unit height.

A mounting hub may be movably coupled to the surface cleaning head and the cleaning unit may be detachably mounted on the mounting hub.

The air treatment member may include a cyclone chamber having a cyclone air inlet in air flow communication with the downstream end of the second upflow conduit.

The cyclone air inlet may be provided toward the bottom of the cyclone chamber.

The surface cleaning apparatus may also include an above floor cleaning wand. The surface cleaning apparatus may be operable in a floor cleaning mode wherein the above floor cleaning wand forms a portion of the air flow passage and an above floor cleaning mode wherein an inlet of the above floor cleaning wand may be detached from air flow communication with the dirty air inlet. The above floor cleaning wand may have an outlet connected upstream from the flexible conduit section.

The cleaning wand may have a wand length, the second upflow conduit may have a second upflow conduit length and the second upflow conduit length may be at least 35% of the wand length.

The second upflow conduit length may be at least 50% of the wand length.

The cleaning wand may be attached to the upper section and when the upper section is in the upright position the inlet of the cleaning wand may be positioned above the upstream end of the second upflow conduit and below the downstream end of the second upflow conduit.

The second upflow conduit may be inclined relative to the upper section so that the upstream end of the upflow conduit is spaced apart from the downstream end of the second upflow conduit in the direction of motion of the surface cleaning apparatus.

DRAWINGS

Reference is made in the detailed description to the accompanying drawings, in which:

Figure 1:
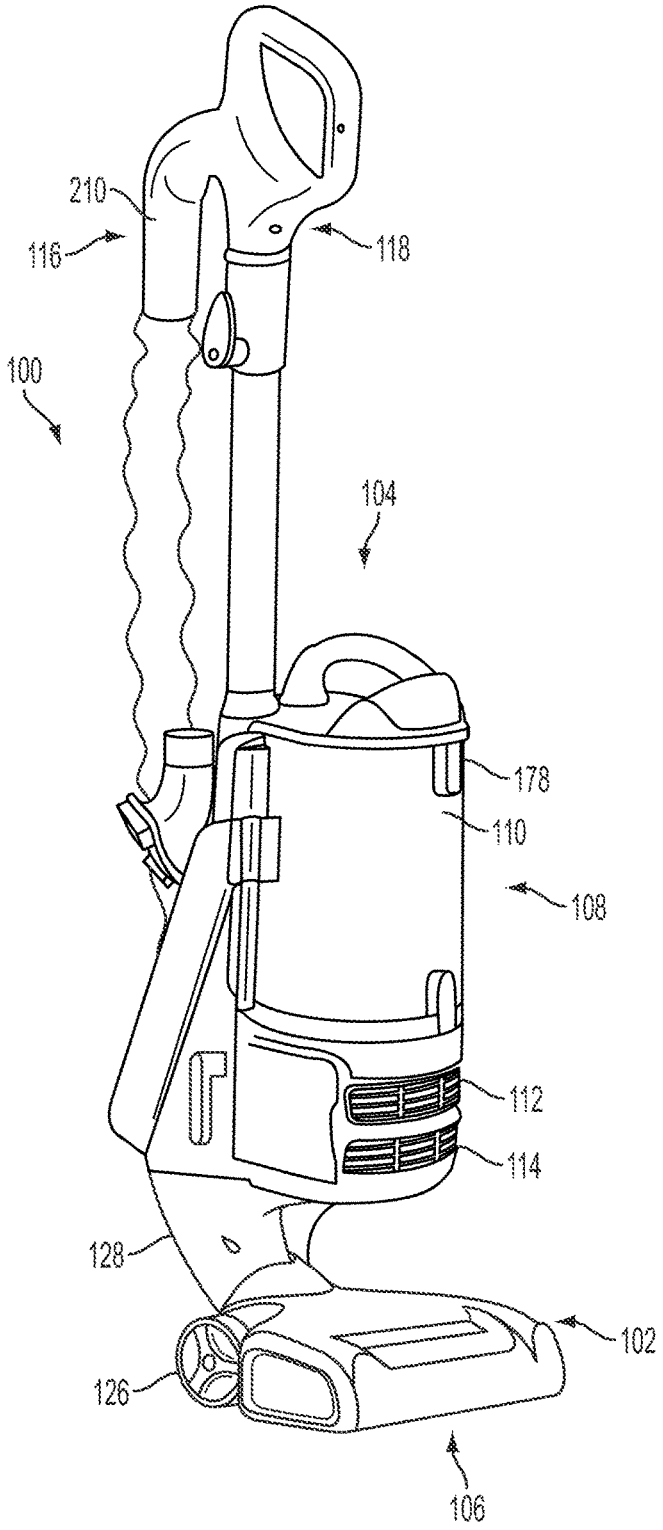
FIG. 1 is a front perspective view of an example of a surface cleaning apparatus.

Where considered appropriate, reference numerals may be repeated among the figures to indicate corresponding or analogous elements.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Referring to FIG. 1, an embodiment of a surface cleaning apparatus is shown. In the embodiment illustrated, the surface cleaning apparatus 100 is an upright surface cleaning apparatus. In alternate embodiments, the surface cleaning apparatus may be another suitable type of surface cleaning apparatus, including, for example, a hand vacuum, a canister vacuum cleaner, a stick vac, a wet-dry vacuum cleaner and a carpet extractor.

As exemplified in FIG. 1, a surface cleaning apparatus 100 is an upright vacuum cleaner that includes a surface cleaning head 102 and an upper section 104. A dirty air inlet 106 may be provided on the surface cleaning head 102 Optionally, the upper section 104 may be configured to include a cleaning unit 108 that contains at least an air treatment member 110 and a suction motor housing 112 containing a suction motor (not shown), and optionally a plurality of other components. Alternatively, the suction motor may be provided in any other suitable location.

Figure 8:
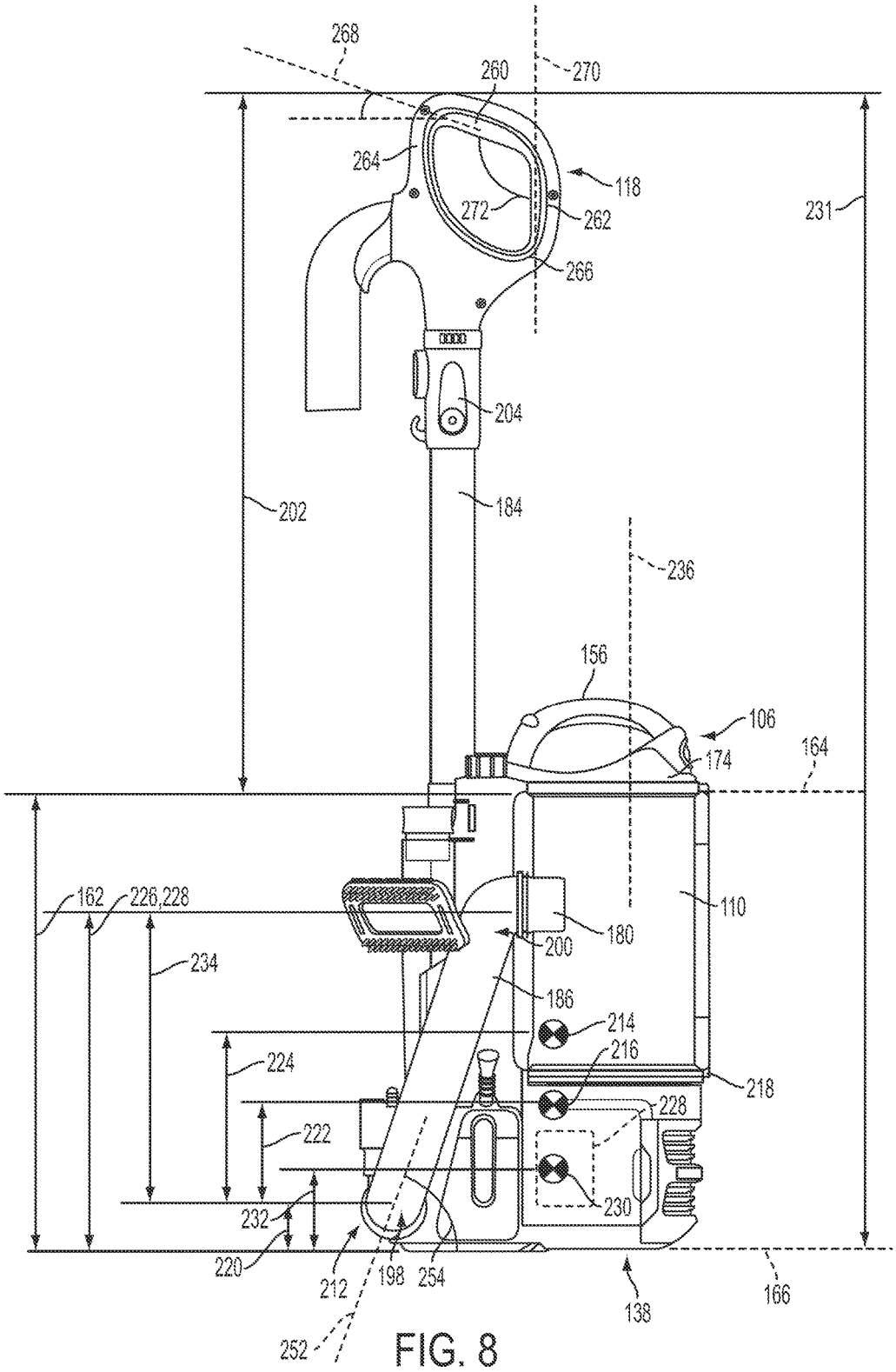
FIG. 8 is a side view of a portion of the surface cleaning apparatus of FIG. 1.
Figure 10:
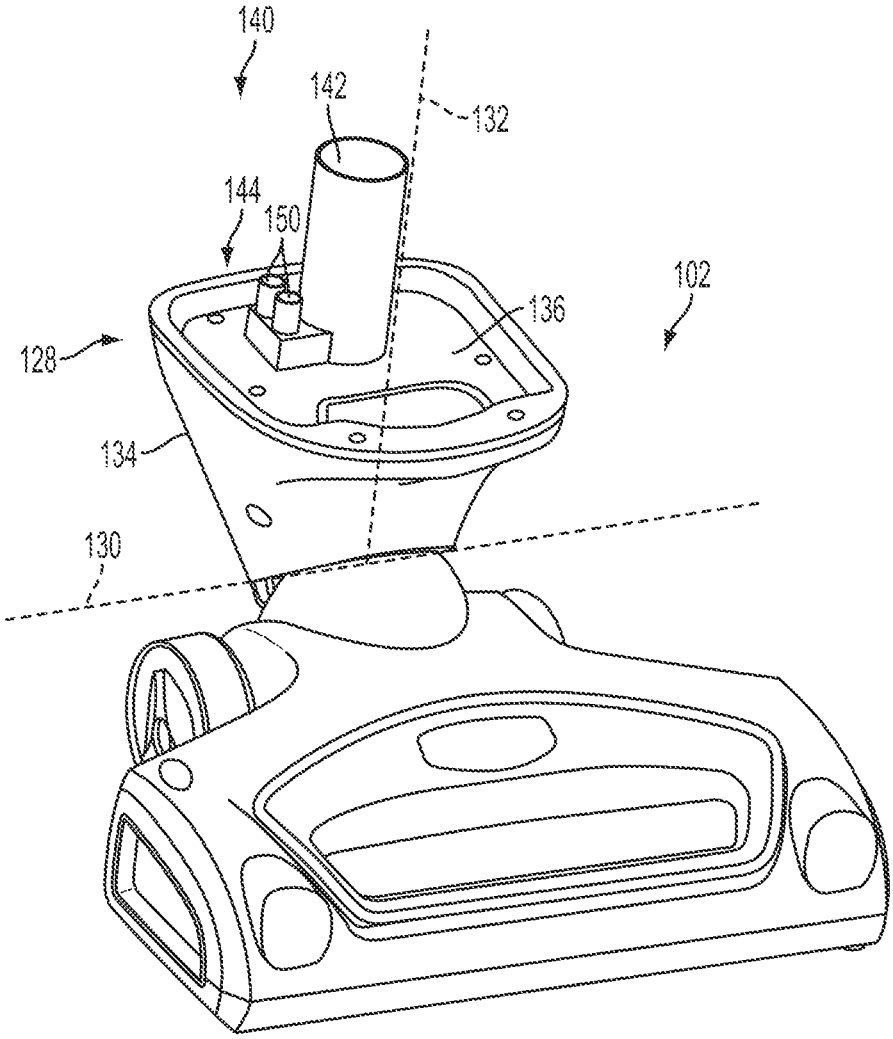
FIG. 10 is a top perspective of a surface cleaning head usable with the surface cleaning apparatus of FIG. 1.

Optionally, the upper section 104, or at least a portion thereof, may be detachable from the surface cleaning head 102 (see for example FIGS. 8 and 10). Alternatively, the upper section may not be detachable from the surface cleaning head.

Preferably, the cleaning unit may include a clean air outlet 114, and an air flow passage 116 may extend between, and fluidly connect, the dirty air inlet 106 and the clean air outlet 114. Alternatively, the clean air outlet may be provided in another location.

Optionally, the surface cleaning apparatus may be operable in more than one cleaning mode. The versatility of operating in different operating modes may be achieved in a plurality of ways, and may be achieved by allowing the cleaning unit to be separated from the surface cleaning head. Alternatively, or in addition, further versatility may be achieved by permitting at least a portion of the upper section to be detached and/or reconfigured. For example, portions of the air flow passage provided on the upper section may be reconfigurable to alter the air flow passage.

For example, the surface cleaning apparatus 100 may be operable in a surface cleaning mode (see for example FIG. 1) in which the cleaning unit 108 is mechanically and fluidly connected to the surface cleaning apparatus 100 and the air flow passage 116 extends between the dirty air inlet 106 on the surface cleaning head 102 and the clean air outlet 114. The surface cleaning apparatus 100 may also be operable in an auxiliary cleaning mode in which the cleaning unit 108 is detached from the surface cleaning head 102 (see for example FIG. 8). In the auxiliary cleaning mode the air flow passage 114 may extend from a different dirty air inlet (for example the inlet **106*a* of an auxiliary cleaning wand 154, cleaning tool or other suitable air inlet—see FIG. 11) to the clean air outlet 114. Preferably, in this configuration the position of the second dirty air inlet 106*a*, for example the end of a cleaning wand 154**, is adjustable relative to the cleaning unit.

A handle 118 is preferably drivingly connected to the upper section 104 for manipulating the surface cleaning apparatus 100. The handle 118 may be of any suitable configuration that may be grasped by a user. While illustrated as being positioned toward the top of the upper section 104, the handle 118 may be provided at any other suitable location on the surface cleaning apparatus 100. When the surface cleaning apparatus 100 in its upright position, the vertical distance 120 between the bottom 122 of the surface cleaning head 102 and the top of the upper section 104, in this case the upper end 124 of the handle, defines a surface cleaning apparatus height 120. The height 120 may be any suitable distance, and may be between about one meter and two meters.

The surface cleaning head 102 may be any suitable type of cleaning apparatus, including, for example a powered cleaning head having a rotating brush and a brushless cleaning head. The surface cleaning head 102 may be of any suitable configuration and may include at least one wheel or other rolling support to contact the surface being cleaned.

In the illustrated example the surface cleaning head 102 includes a pair of rear wheels 126 and a pair of front wheels (optionally caster-type wheels, not shown) for rolling across a surface and the dirty air inlet 106 provided at the front end.

If the surface cleaning apparatus is an upright surface cleaning apparatus, then the upper section 104 may be moveably connected to the surface cleaning head 102 by any means known in the art. As exemplified in FIG. 10, optionally, the surface cleaning apparatus 100 may include a mounting hub 128 (of any suitable configuration) or other suitable structure, and the upper section 104 can be detachably mounted to the mounting hub 128. Preferably, the mounting hub 128 can be pivotally coupled to the surface cleaning head 102, using any suitable pivot joint, so that both the mounting hub 128 and the upper section 104 can be pivoted, for example about a pivot axis 130, relative to the surface cleaning head 102. Optionally, the upper section 104 can be rotatably coupled to the mounting hub 128, and/or at least a portion of the mounting hub 128 can be rotatable relative to the surface cleaning head 102, for example about a pivot axis 132. This configuration may allow the upper section 104 to be rotated relative to the surface cleaning head 102, at least when the surface cleaning apparatus 100 is in use. Preferably, the upper section 102 is at least moveable (e.g., pivotally mounted to the surface cleaning head) between an upright or storage position and an in use position.

Figure 9:
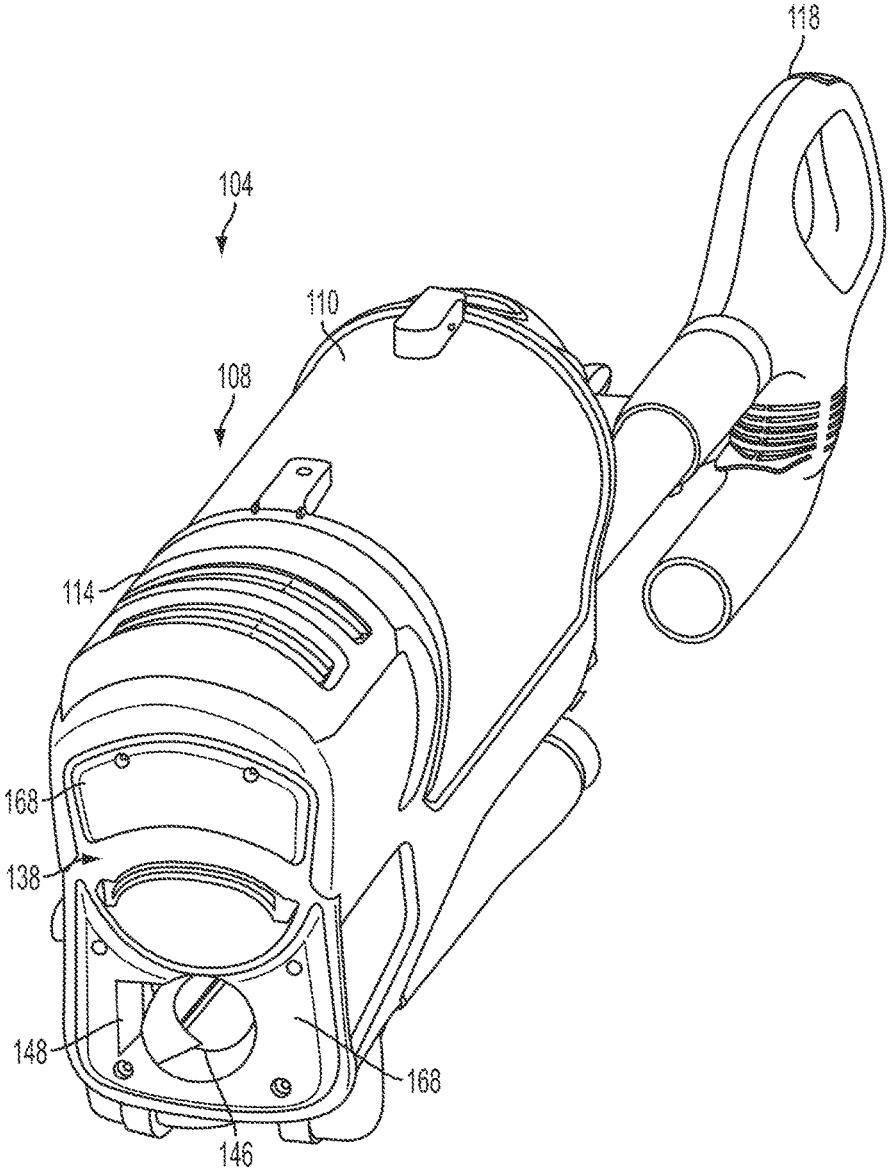
FIG. 9 is a bottom perspective view of a portion of the surface cleaning apparatus of FIG. 1.

As exemplified in FIG. 10, in the illustrated example the surface cleaning apparatus 100 includes a mounting hub 128 that has an outer housing 134 and is configured to provide an upwards facing support surface 136, upon which a corresponding portion of the upper section 104 can rest. For example, as exemplified in FIG. 9, the upper section 104 can include a downward facing bearing surface 138 that is configured to engage the support surface 136.

Optionally, the mounting hub 128 can be configured to provide connections 140 for one or more services or components of the surface cleaning apparatus 100. This may allow a plurality of services, such as vacuum air flow and/or electrical power, to be transferred between the upper section 104 and the surface cleaning head 102 when the upper section 104 is mounted on the mounting hub 128. Preferably, the connections 140 provided are configured so that they can be automatically engaged and/or disengaged by placement and removal of the upper section 104, respectively, without requiring a separate actuator or triggering mechanism. Alternatively, a plurality of switches, valves and other suitable hardware can be provided.

In the illustrated example, the mounting hub 128 includes a mounting post 142 and an electrical connector 144. In this example, the mounting post 142 is a hollow conduit member and can optionally form a portion of the air flow passage 116 extending between the dirty air inlet 106 and the clean air outlet 114. In this configuration, the mounting post 142 may provide the fluid connection between the surface cleaning head 102 and the upper section 104. Alternatively, the mounting hub 128 may include separate mounting and air flow members.

When the upper section 104 is mounted on the support platform 136, the mounting post 142 is at least partially received within a corresponding recess 146 in the bottom of the cleaning unit 108. The recess 146 may be in fluid communication with other conduit members to help complete the air flow passage 116. While illustrated as having a generally circular cross-sectional shape, the mounting post 142 and recess 146 may be of any other suitable, corresponding cross-sectional shapes, including, for example, rectangular and polygonal. Optionally, a fastener (for example a detent or other suitable fastener—not shown) can be provided within the recess 146 to selectably lock the mounting post 142 within the recess. This may help secure the surface cleaning head 102 to the cleaning unit 108. Optionally, such a connection may be the only locking mechanism used to releasably secure the surface cleaning head 102 to the cleaning unit 108. If a fastener is provided to engage the mounting post 142 (or any other suitable portion of the mounting hub) any suitable fastener release trigger may be provided on the upper portion 104. Actuating the trigger may release the fastener securing them mounting post 142 within the recess 146, thereby allowing the cleaning unit 108 to be lifted off of the surface cleaning head 102.

The electrical connector 144 may be any suitable electrical connector that can be configured to mate with an optional, corresponding electrical connector 148 provided on the upper section. In the illustrated example, the electrical connector 144 on the surface cleaning head includes prongs 150 and the electrical connector 148 on the upper section includes a corresponding socket to receive the prongs 150. Other types of electrical connectors can be used.

Figure 2:
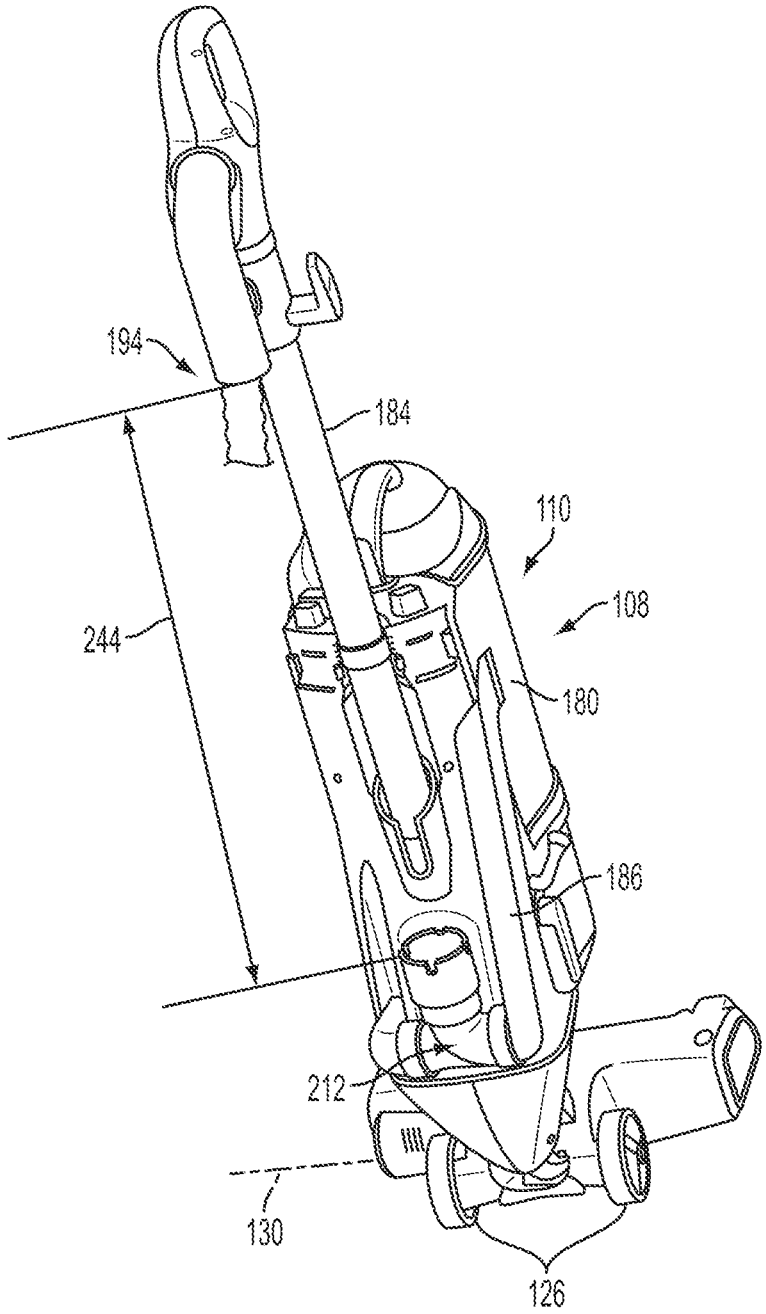
FIG. 2 is rear perspective view of the surface cleaning apparatus of FIG. 1.
Figure 3:
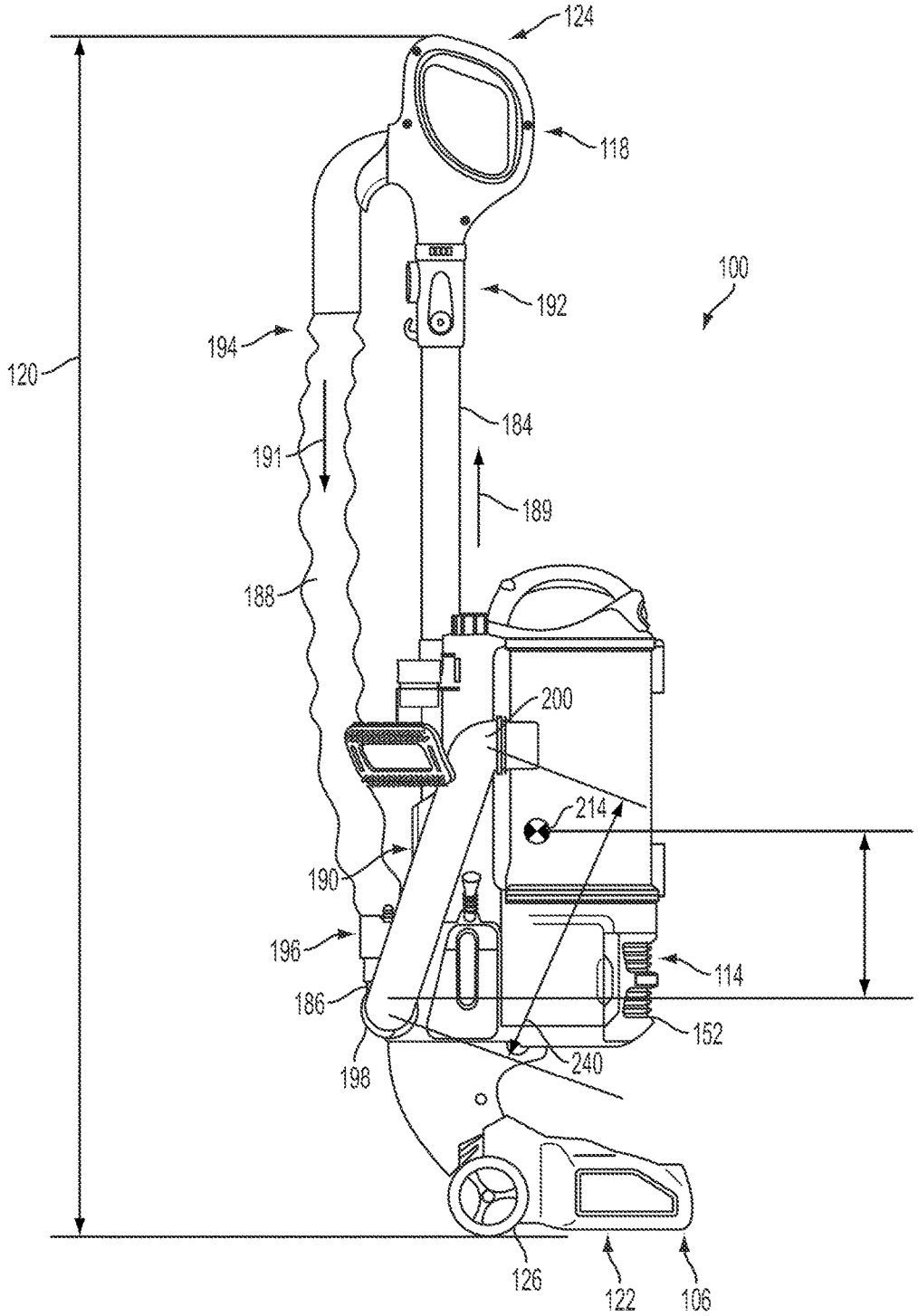
FIG. 3 is a side view of the surface cleaning apparatus of FIG. 1.

Referring to FIGS. 1-3, in the example illustrated, the upper section 104 comprises a cleaning unit 108 that includes an air treatment member 110 and a suction motor housing 112, which is preferably positioned below air treatment member 110. Alternatively, the upper section 104 may be of any suitable configuration.

The air treatment member 110 may be positioned in the air flow passage downstream from the dirty air inlet 106 to remove dirt particles and other debris from the air flowing through the air flow passage 116. The air treatment member 110 may be any suitable type of treatment member that includes any one or more of the features disclosed herein and may include, for example, a bag, a filter, one or more cyclones and any other apparatus that may help separate dirt from the air flowing through the air flow passage 116. In the illustrated example, the air treatment member is a cyclone bin assembly 110.

The clean air outlet 114 may be provided in the cleaning unit 108 and may be positioned downstream from the suction motor. Optionally, one or more filters or filtration members, for example a HEPA filter, can be provided at the clean air outlet 114. A grill 152 (FIG. 3), or other suitable cover member, may be provided at the clean air outlet 114 to help contain any such filters. Optionally, the grill 152 may openable, or preferably detachable, to allow access to the filter at the clean air outlet 114.

Optionally, the cleaning unit 108 may be configured as a generally self-contained unit or pod that is detachable from the surface cleaning head 102. In this configuration, the cleaning unit 108 is preferably configured to contain at least the air treatment member 110 and suction motor and may be re-configured to provide an auxiliary dirty air inlet in the communication with the air treatment member 110.

Figure 11:
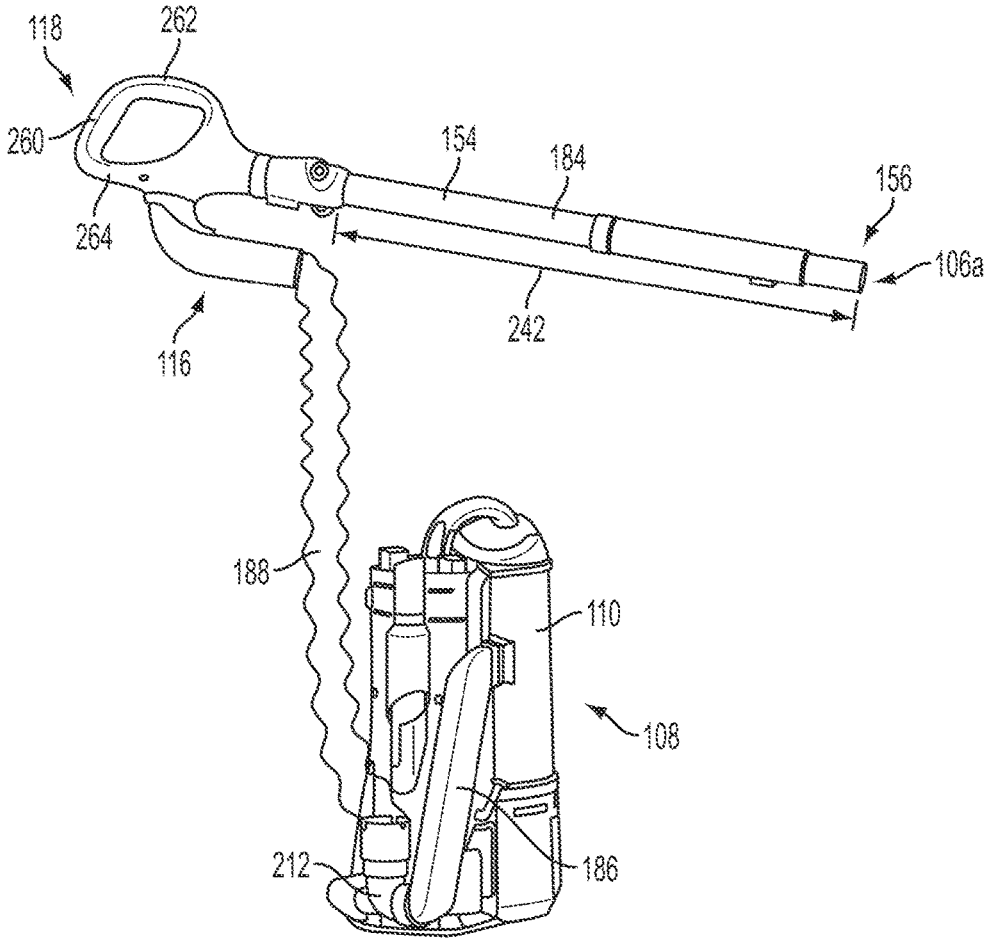
FIG. 11 is a perspective view of a portion of the surface cleaning apparatus of FIG. 1 in an auxiliary cleaning mode.

For example, the upper portion 104 may include a detachable, above-floor cleaning wand 154 (or any other suitable auxiliary cleaning tool). As exemplified in FIGS. 11 and 12, the cleaning wand 154 may have an inlet 156 that can be detached or separated from the cleaning unit 108 and serve as an auxiliary dirty air inlet 106*a*. In this configuration, the cleaning unit 108 may be operated as a stand-alone cleaning apparatus when it is separated surface cleaning head 102, as illustrated in FIG. 11. For example, a user may wish to separate the cleaning unit 108 from the surface cleaning head 102 and utilize the above floor cleaning wand 154 to clean furniture, window covers, ceiling corners and any other such features. Detaching the surface cleaning head 102 may allow a user to carry only the cleaning unit 108, without requiring the user to lift the weight of the surface cleaning head 102.

Figure 12:
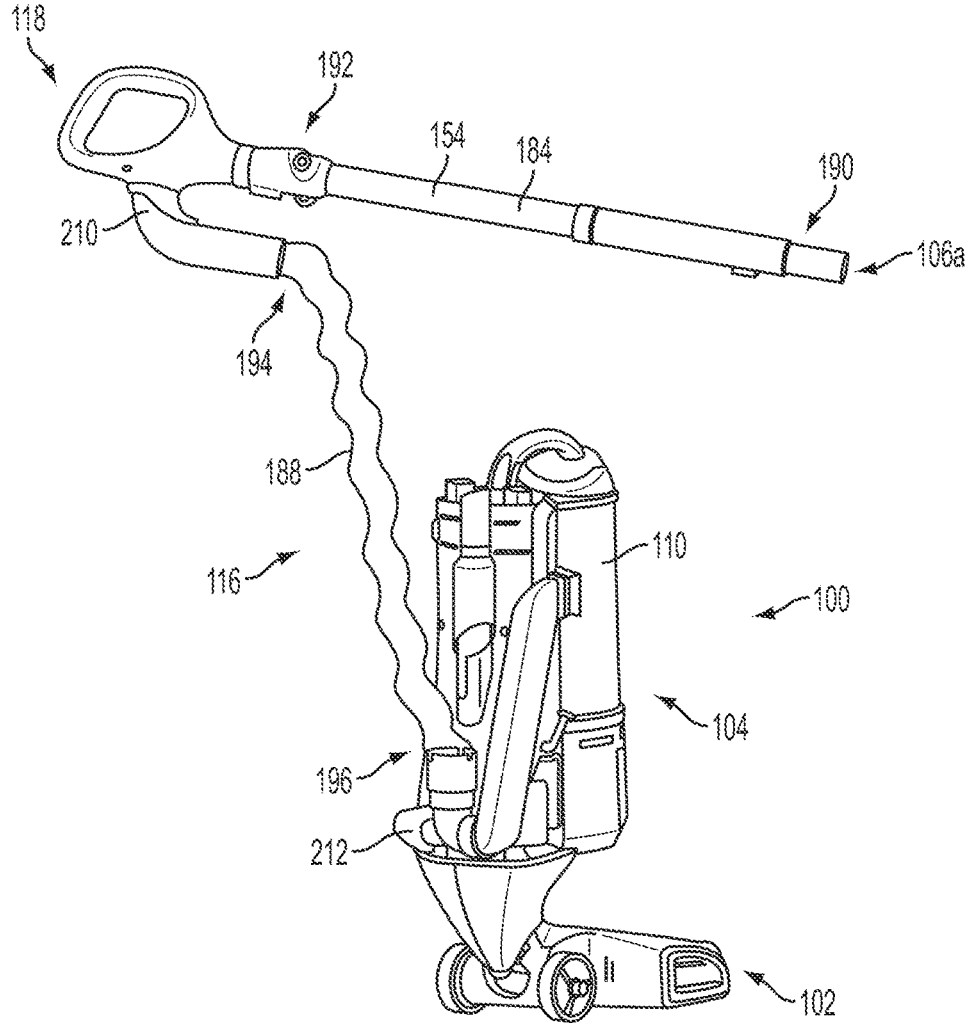
FIG. 12 is a perspective view of the surface cleaning apparatus of FIG. 1 in an auxiliary cleaning mode.
Figure 13:
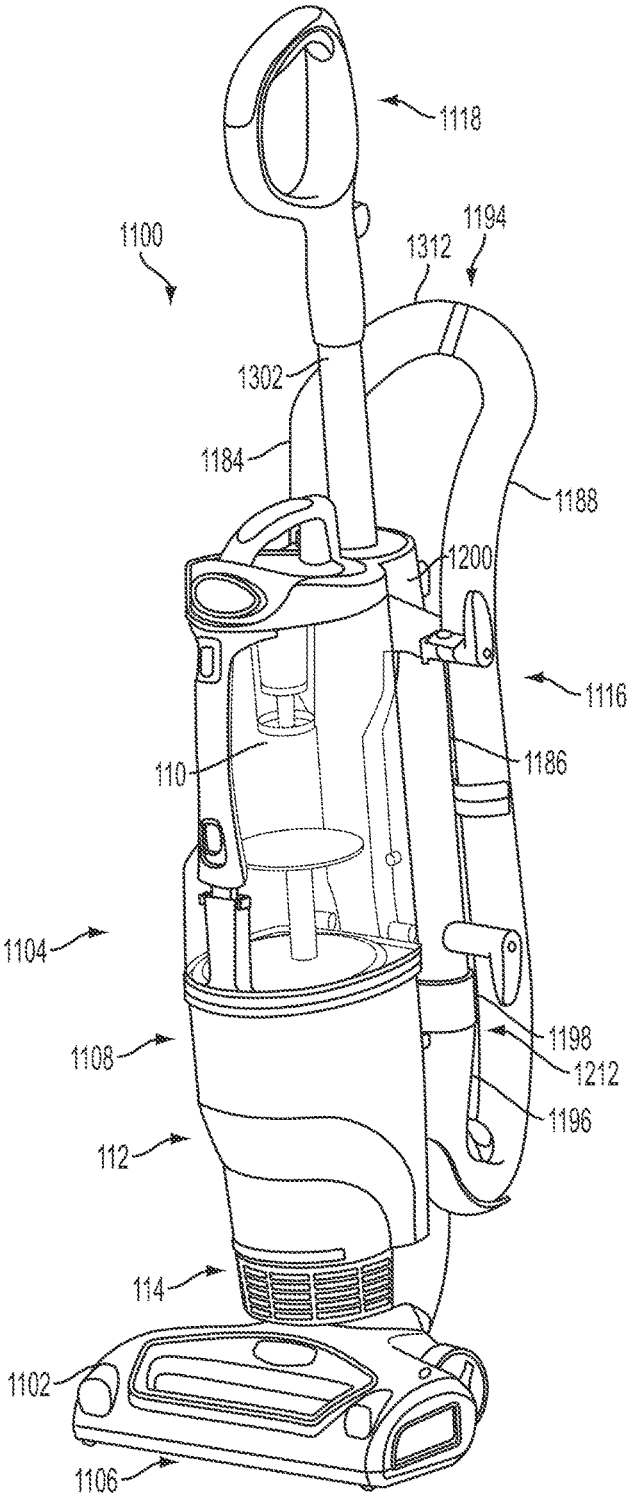
FIG. 13 is a front perspective view of another example of a surface cleaning apparatus.
Figure 14:
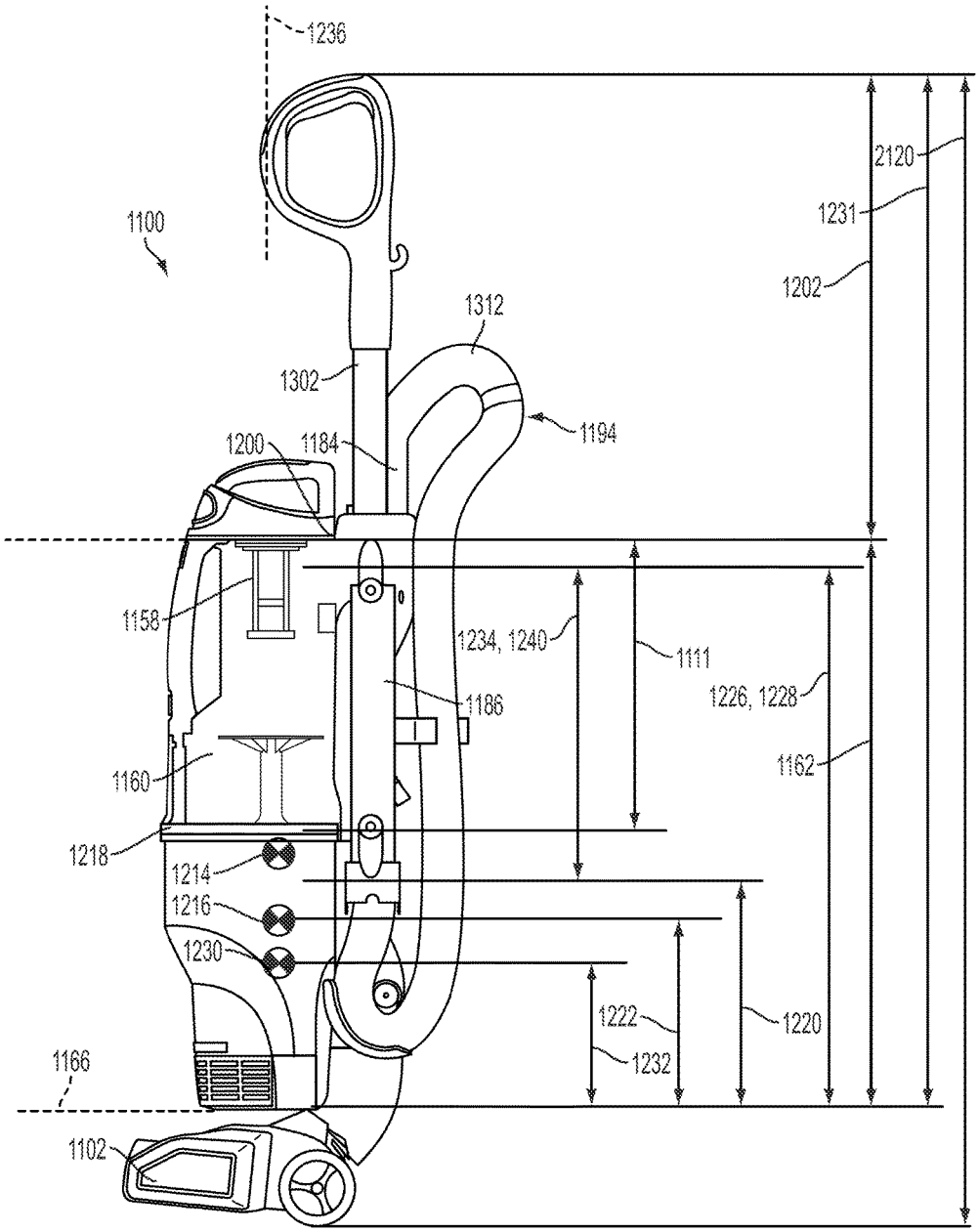
FIG. 14 is a side view of the surface cleaning apparatus of FIG. 13.

Alternatively, as exemplified in FIG. 12, a user may wish to detach and use the cleaning wand 154 when the surface cleaning head 102 is still attached to the cleaning unit 108. This may allow the cleaning unit 108 to be supported on the surface cleaning head 102 while a user manipulates the cleaning wand 154.

A handle may be provided on the cleaning unit 108 to help a user grasp and manipulate the cleaning unit 108 when it is separated from the surface cleaning head. Optionally, the handle provide on the cleaning unit 108 can be an auxiliary handle, such as handle 156, that is separate from the primary handle 118. The handle 156 may be of any suitable configuration, and may be provided at any suitable location on the cleaning unit 108. Optionally, the handle 156 can be provided on the cyclone bin assembly 110 and may also be used to carry the cyclone bin assembly 110 when the cyclone bin assembly is separated from the cleaning unit 108 (see FIG. 5), for example, to empty dirt from the cyclone bin assembly 110. Alternatively, more than one handle may be provided on the cleaning unit 108.

Figure 4:
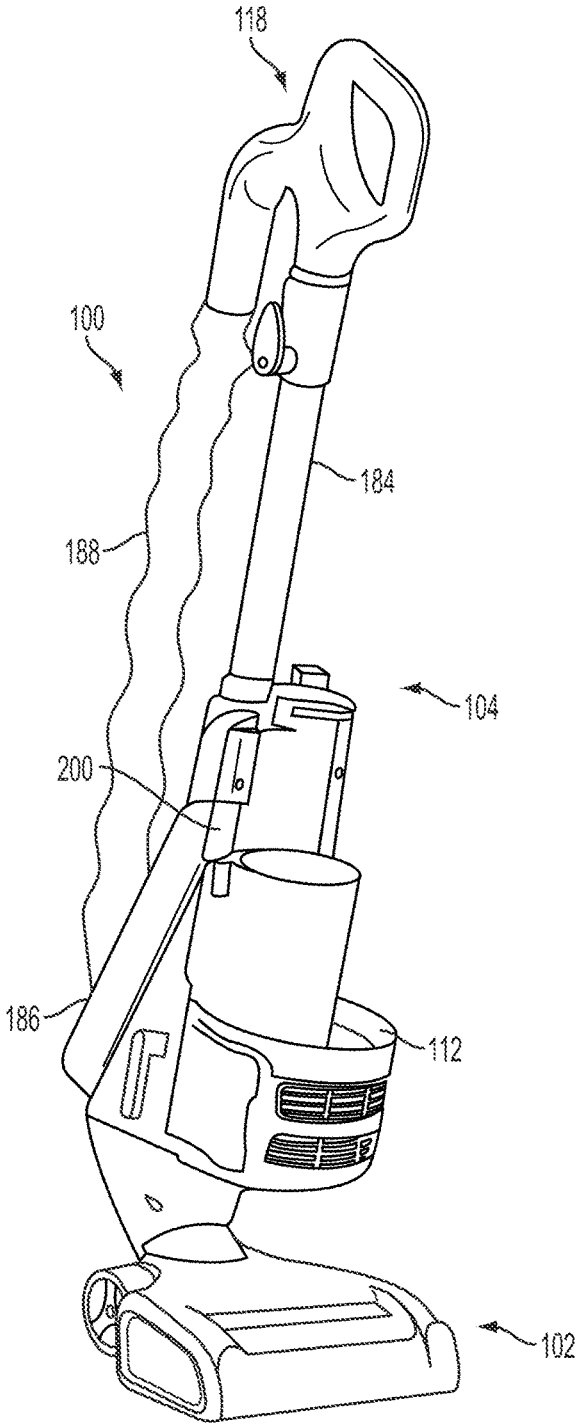
FIG. 4 is a front perspective view of a portion of the surface cleaning apparatus of FIG. 1.
Figure 5:
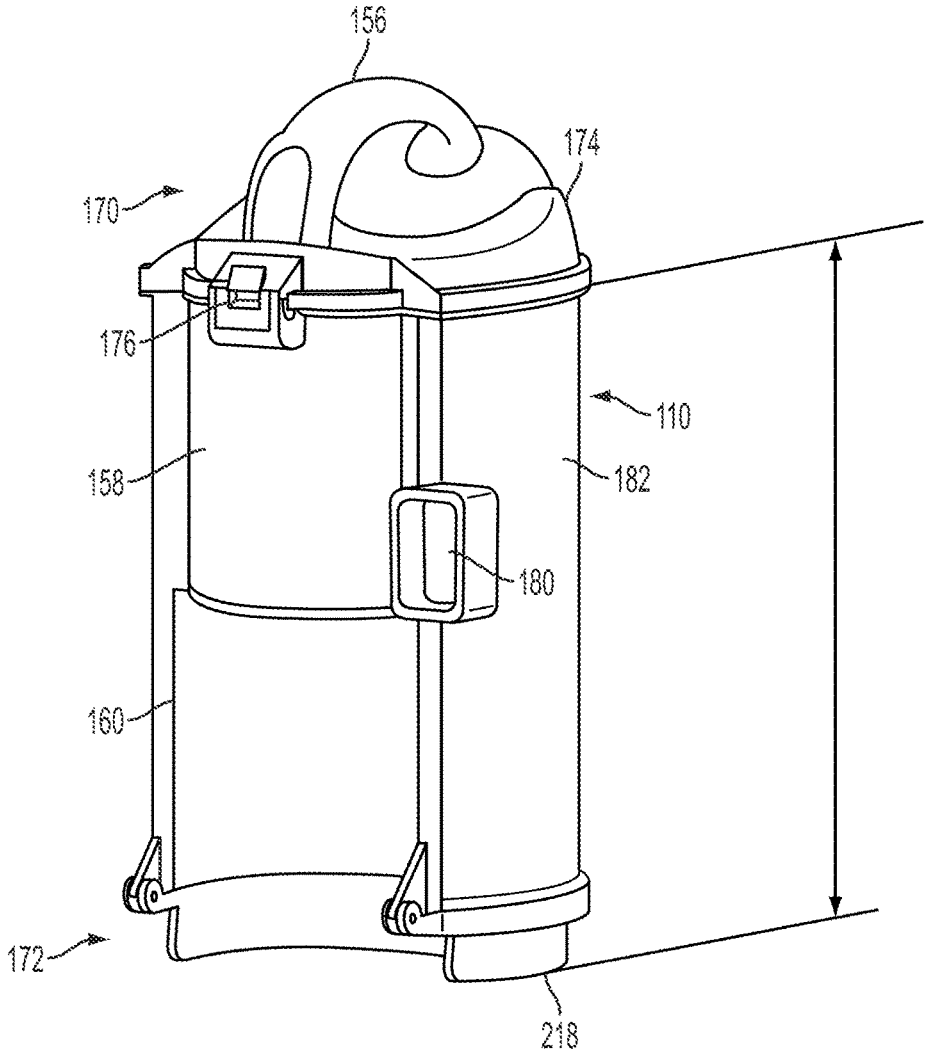
FIG. 5 is a rear perspective view of a cyclone bin assembly usable with the surface cleaning apparatus of FIG. 1.

In the illustrated example, as exemplified in FIG. 5, the air treatment member comprises a cyclone bin assembly 110 comprising a cyclone chamber 158 and a dirt collection chamber 160. Referring also to FIG. 4, in the illustrated example the suction motor housing 112 is configured to house a suction motor (not shown). Preferably, as exemplified, the suction motor may be in air flow communication with the air flow passage 116, downstream from the cyclone bin assembly 110. The suction motor may be any suitable motor and may be selected based on a plurality of factors including, for example, suction strength, operating noise, power consumption and physical size. The housing 112 may be formed to accommodate the selected suction motor as well as mating with and optionally supporting the cyclone bin assembly 110.

Preferably, the cleaning unit 108 may be configured so that the cyclone bin assembly 110 is provided toward one end of the cleaning unit, the top as illustrated in FIG. 8, and the suction motor may be provided toward the other end of the cleaning unit, i.e. toward the bottom of the cleaning unit 108. In this configuration, the distance 162 between the top of the cyclone bin assembly (in this case measured from a plane 164 that contains the upper endwall of the cyclone chamber 158) and the downward facing bearing surface 138 (or the plane 166 containing the surface 138) defines a cleaning unit height 162. In other configurations, the height may be defined between the upper most and lower most portions of the cleaning unit.

Optionally, the bearing surface 138 may include one or more support members configured to rest on the floor, or other such surface, when the cleaning unit 108 is detached from the surface cleaning head 102. For example, a user may wish to rest the cleaning unit 108 on the floor next to an object that is being cleaned, for example a given piece of furniture, rather than holding the cleaning unit 108 during the entire cleaning process. Providing support members on the cleaning unit 108 may help improve the stability of the cleaning unit 108 and may help protect portions of the cleaning unit, such as the electrical socket 148, from impact and/or damage. As exemplified in FIG. 9, in this configuration the support members may include one or more support feet 168 extending from the cleaning unit 108. Optionally, the support feet 168 may be integrally formed with the cleaning unit 108, or may be provided as separate members that can be attached to the cleaning unit 108.

Optionally, the support members may include at least one wheel or other type of rolling support member in addition to, or as an alternative to the support feet. Providing at least one rolling support member may allow the cleaning unit 108 to roll across the floor without the need for mounting the cleaning unit 108 on the surface cleaning head 102. This configuration may allow a user to roll the cleaning unit 108 across the floor, instead of lifting it, and/or may allow the cleaning unit 108 to be pulled along behind a user when in use.

When the cleaning unit 108 is mounted on the surface cleaning head 102, the cleaning unit support members, for example feet 168, may be at least partially nested within or otherwise accommodated by the mounting hub 128, or may be external the mounting hub 128.

The cyclone bin assembly 110 may be of any suitable design. For example, the cyclone bin assembly may be of any suitable configuration, size and shape. The cyclone chamber may be configured in a plurality of different configurations, including, for example, an upright cyclone, an inverted cyclone and a horizontal or transverse cyclone, and optionally may include more than one cyclones. As exemplified in FIG. 5, in the illustrated example, the cyclone bin assembly 110 includes cyclone chamber 158, configured as an inverted cyclone chamber, and a dirt collection chamber 160 disposed below the cyclone chamber 158. Preferably, the dirt collection chamber 160 may be configured to cooperate with the cyclone chamber 158, as well as connect with the rest of the surface cleaning apparatus 100. The cyclone chamber 158 may be integrally formed with the dirt collection chamber 160, or optionally may be separable from the dirt collection chamber 160.

Preferably, at least a portion of the cyclone bin assembly 100 is removable from the upper section 104 of the surface cleaning apparatus 100 to help facilitate emptying of the dirt collection chamber 160. More preferably, the entire cyclone bin assembly 110 is detachable, as illustrated in FIG. 5. To help facilitate emptying and/or inspection at least one of, or both of the top 170 and bottom 172 of the cyclone bin assembly 110 may be openable to provide access to the interiors of the cyclone chamber 158 and/or the dirt collection chamber 160.

Optionally, some or all of the cyclone bin assembly 110 may be formed from a transparent or semi-transparent material, such as plastic, so that a user may visually inspect the contents of the cyclone bin assembly 110, for example the contents of the dirt collection chamber 160, without having to open or disassemble the cyclone bin assembly 110. This may also allow a user to inspect the interior of the cyclone bin assembly 110 while the surface cleaning apparatus 100 is in use.

Preferably a lid 174 covers the top 170 of the cyclone chamber 158. Optionally, an inner surface of the lid 174 may form the first end wall of the cyclone chamber 158. Preferably, the lid 174 is openable and/or detachable from the cyclone bin assembly 110 by any means known in the art.

Opening the lid 174 may allow a user to access the interior of the cyclone chamber 158, for example for cleaning. The lid 174 may be pivotally connected to the cyclone bin assembly 110 by any suitable mechanism, including for example a hinge 176, and may be movable between a closed configuration and an open configuration. The lid 174 may be held in the closed position by any means known in the art, such as a releasable latch 178 (FIG. 1). The handle 156 may be provided on the lid 174.

Preferably, a tangential air inlet 180 is provided in the sidewall 182 of the cyclone chamber 158 and is in fluid communication with the dirty air inlet 106, or 106*a*. The tangential air inlet 180 may be of any suitable design and/or cross sectional area and may be provided at any suitable location along the sidewall 182 of the cyclone chamber 158. Air flowing into the cyclone chamber 158 via the air inlet 180 may circulate around the interior of the cyclone chamber 158 and dirt particles and other debris may become disentrained from the circulating air.

The dirt collection chamber 160 may be provided to receive and retain dirt and debris that is separated from the dirty air flow via the cyclone chamber 158. The dirt collection chamber 160 may be any suitable configuration that may accommodate a given cyclone chamber 158, and may be formed from any suitable material, including, for example plastic and metal. At least a portion of the air circulating within the cyclone chamber 158 may flow into and circulate within the dirt collection chamber when the cyclone bin assembly is in use. After having circulated within the dirt collection chamber 160, the air may flow back into the cyclone chamber 158 and exit via the air outlet (not shown) of the cyclone chamber 158.

Optionally, the dirt collection chamber 160 may be a unitary, integrally formed chamber and/or may be of any suitable cross-sectional shape, and may have a varying cross-sectional shape along its height.

An air flow passage 116 extends from the dirty air inlet 106 and/or 106*a* to a clean air outlet 114, which is preferably provided on the upper section 104. The air flow passage 116 may include any suitable combination of rigid conduits, flexible conduits, chambers and other features that may cooperate to direct a flow of air through the surface cleaning apparatus. The upper section 104 may be of various configurations and the air flow passage 116 may be configured to travel in a plurality of different routes within and/or around the upper section 104 and/or cleaning unit 108.

Preferably, the air flow passage 116 is a re-configurable air flow passage that can be positioned in at least two different operating configurations.

Preferably, the air flow passage 116 includes at least one flexible conduit section. Providing a flexible conduit section may help facilitate re-configuration of the air flow passage. Optionally, the flexible conduit section can be positioned between two generally rigid conduit sections. Preferably, the flexible conduit section can include at least one flexible hose. Alternatively, the air flow passage can include any suitable combination of conduit members.

Preferably, at least one of the conduit sections is provided on the cleaning unit 108, and optionally may be at least partially integrally formed with the cleaning unit 108. Alternatively, all of the air flow conduit portions may be external to the cleaning unit 108.

Figure 6:
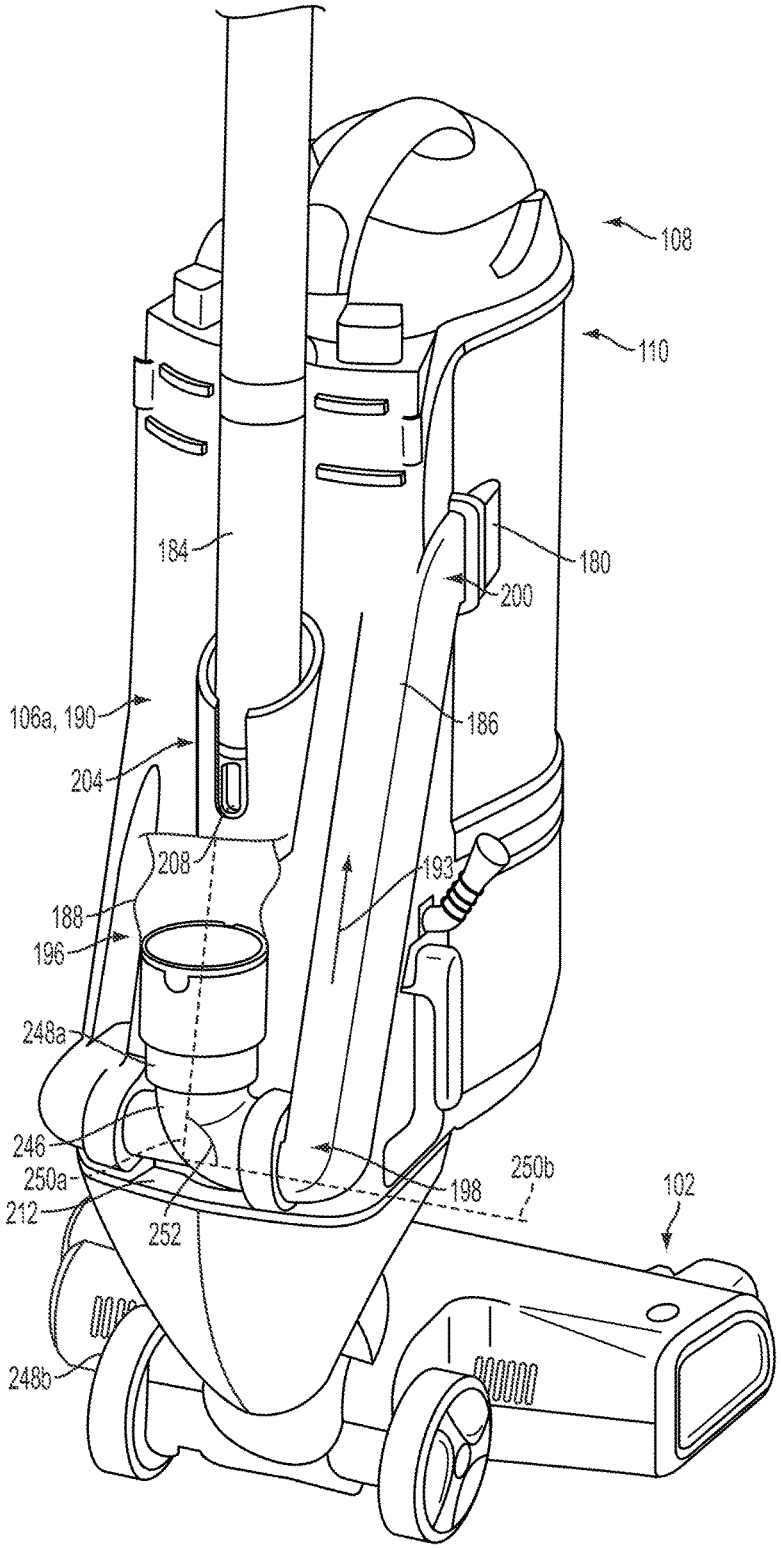
FIG. 6 is a rear perspective view of a portion of the surface cleaning apparatus of FIG. 1.
Figure 7:
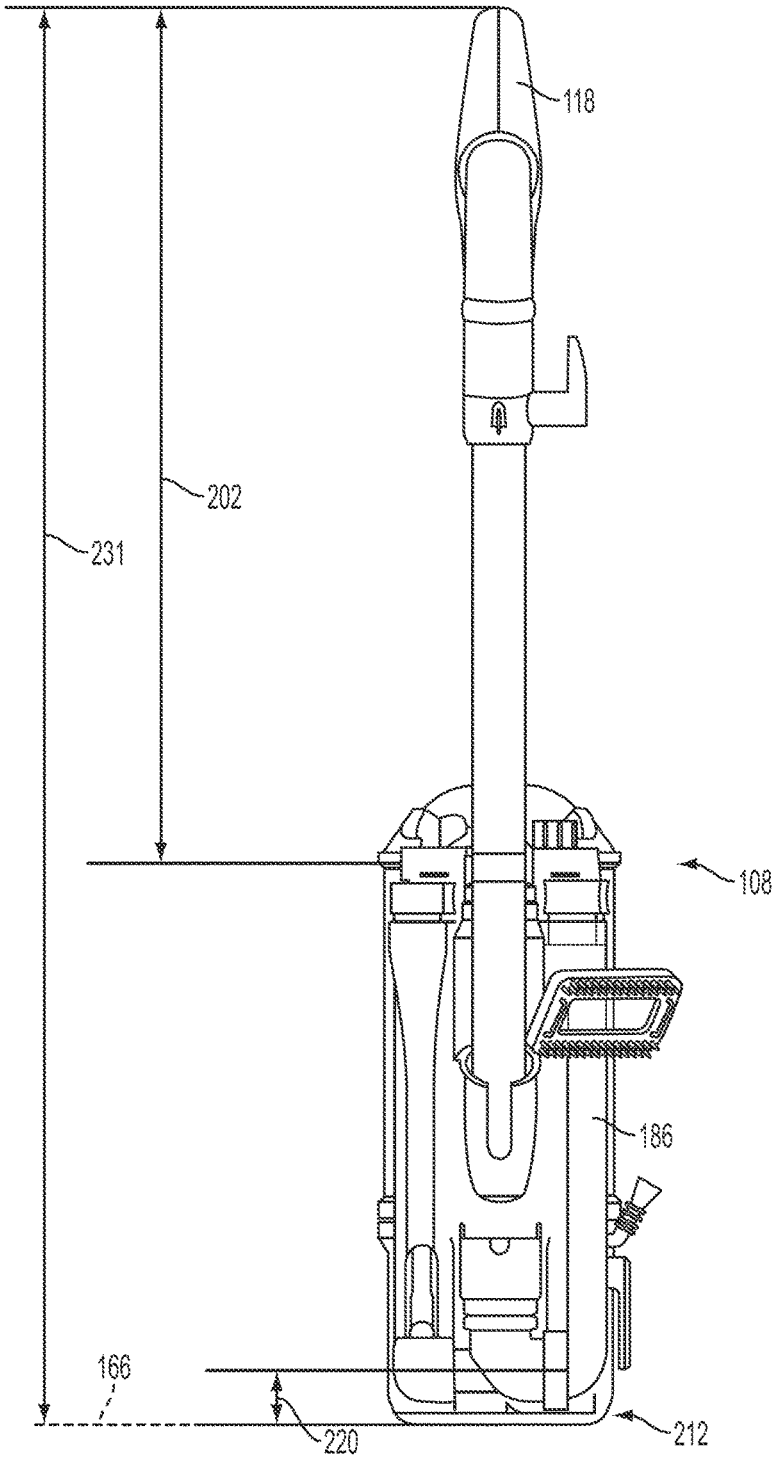
FIG. 7 is a rear view of a portion of the surface cleaning apparatus of FIG. 1.

As exemplified in FIGS. 2, 3 and 6, in the illustrated example, a portion of the air flow passage 116 provided in the upper section 104 includes a first upflow conduit 184, a second upflow conduit 186 and a downflow conduit 188 positioned between the first and second upflow conduits 184 and 186. In FIG. 2, and in some other Figures, the downflow conduit 188 is not illustrated.

In this configuration, when the cleaning unit 108 is mounted on the surface cleaning head (FIG. 3), dirty air may be drawn in via the dirty air inlet 106 and may flow through the surface cleaning head 102 and into the recess 146 in the bottom of the cleaning unit 108. The dirty air may then flow upwards (i.e. generally away from the bottom of the cleaning unit 108 as illustrated by arrow 189 in FIG. 3) into an upstream end 190 of the first upflow conduit 184 (see FIGS. 3 and 6) and travel to an opposed downstream end 192 of the first upflow conduit 184. In the illustrated example, the downstream end 192 of the first upflow conduit 184 is provided proximate the handle 118.

From the first upflow conduit 184, the dirty air may travel into the upstream end 194 of the downflow conduit 188, and then flow downwards (i.e. generally toward the bottom of the cleaning unit 108 as illustrated by arrow 191 in FIG. 3) to an opposed downstream end 196 of the downflow conduit 188. The air may then be transferred from the downstream end 196 of the downflow conduit 188 to the upstream end 198 of the second upflow conduit 186. The dirty air may then travel generally upwards from the upstream end 198 of the second upflow conduit 186 to the downstream end 200 of the upflow conduit 186 (as illustrated by arrow 193). Preferably, as illustrated, the upstream end 198 of the second upflow conduit 186 is positioned lower on the cleaning unit 108 than the downstream end 200 of the second upflow conduit 186.

From the downstream end 200 of the second upflow conduit 186, the dirty air may flow into the air inlet 180 of the cyclone bin assembly 110 (or other suitable air treatment member). In this configuration, the air flow passage 116 includes at least one downward or downflow conduit section, for example conduit 188, provided between two separate upward or upflow conduit sections, for example conduits 184 and 186. The air flow passage 116 may also include any other suitable conduit sections as desired. Optionally, some or all of the first upflow conduit 184, second upflow conduit 186 and downflow conduit 188 may be flexible and/or may include flexible conduit portions.

Preferably, the first upflow conduit 184 is a generally rigid conduit member, such as a plastic tube, and also serves as a structural load carrying member. In the illustrated example, the rigid upflow tube 184 also functions as a support for the handle 118 and allows a user to manipulate the surface cleaning apparatus 100. In this configuration, the upflow conduit 184 may extend from its lower end proximate the cleaning unit 108 and or surface cleaning head 102, to its upper end that is positioned above the air treatment member 108 (when the surface cleaning apparatus 100 is in the upright position). Preferably, the position of the upper end of the first upflow conduit 184 can be selected so that the handle 118 is at a comfortable height for a user. The spacing 202 between the handle 118 and the top of the cleaning unit 108 (as defined by plane 164 in FIG. 8) may be any suitable distance, and may be between 0.25 meters and 1.5 meters. Optionally, the spacing 202 may be adjustable to allow a user to vary the height of the handle 118 relative to the cleaning unit 108 and/or the surface cleaning head 102.

Alternatively, some or all of the upflow conduit 184 may be flexible or otherwise non-load bearing. Optionally, other components of the surface cleaning apparatus 100 may be mounted to the exterior of the first upflow conduit 184, including, for example an electrical cord wrap member 204 (FIG. 8). The first upflow conduit 184 may be formed in any suitable size and cross-sectional shape, and need not be circular in cross-sectional shape as illustrated.

Optionally, at least a portion of the first upflow conduit 184 may be detachable or separable from the cleaning unit 108. In the illustrated example, the first upflow conduit 184 forms the detachable above-floor cleaning wand 154 (as exemplified in FIGS. 11 and 12). The inlet 106*a* of the cleaning wand 154 may form the upstream end 190 of the first upflow conduit 184 and may detachably connected to the cleaning unit 108 using any suitable mechanism. For example, the inlet 106*a* of the cleaning wand 154 can be insertable within a corresponding dock portion 206 on the cleaning unit 108 (FIG. 6), and may be held in place using any suitable fastener, such as a releasable latch 208. When in this position, the cleaning wand 154 and/or the rest of the first upflow conduit 184 may form part of the air flow passage 116 connecting the dirty air inlet 106 to the clean air outlet 114 and may be drivingly connected to the surface cleaning head 102. Preferably, the inlet 106*a* of the cleaning wand 154 can be detached from the cleaning unit when the cleaning unit is mounted on the surface cleaning head (FIG. 12), and when the cleaning unit 108 is separated from the surface cleaning head 102 (FIG. 11). The downstream end 192 or outlet of the cleaning wand 154 may be provided adjacent the handle 118.

In this configuration, the downstream end 192 of the cleaning wand also serves as the downstream end of the first upflow conduit 184. Alternatively, the first upflow conduit 184 may have a downstream end or outlet that is discrete from the cleaning wand outlet.

From the downstream end 192 of the first upflow conduit 184, the dirty air can flow into the upstream end 194 of the downflow conduit 188, which is also provided proximate the handle 118 (FIG. 3 and FIG. 12). Optionally, a rotatable or otherwise moveable connection can be provided between the downstream end 192 of the first upflow conduit 184 and the upstream end 184 of the downflow conduit 188. The dirty air can travel within the downflow conduit 188 until it reaches the downstream end 196 of the downflow conduit 188.

When the inlet of the cleaning wand 154 is detached from the cleaning unit, it may serve as an auxiliary dirty air inlet 106*a* for the surface cleaning apparatus 100. Optionally, the inlet 106*a* of the wand 154 may be configured to be connected to one or more auxiliary cleaning tools, such as a crevice tool and/or an upholstery cleaning tool.

Alternatively, or in addition, there may be one or more additional separation points or junctures in the air flow passage, and optionally, within the first upflow conduit 184 portion. For example, the surface cleaning apparatus 100 may be configured so that the handle 118 may include an internal air flow conduit portion 210 (FIGS. 1 and 12) and may be detachable from the downstream end 192 of the cleaning wand conduit 154. In this configuration, the handle 118 may be de-coupled from the cleaning wand 154 and may then form an auxiliary dirty air inlet that may be used on its own, and/or may be attached to one or more auxiliary cleaning tools. Additional detachment points may be provided along the length of first upflow conduit 184 and at any other suitable position within the air flow passage 116.

The upstream end 194 of the downflow conduit 188 may be connected, directly or indirectly, to the downstream end 192 of the first upflow conduit 184 and the downstream end 196 of the downflow conduit may be connected, directly or indirectly, to the upstream end 198 of the second upflow conduit 186.

The downflow conduit 188 can be any suitable conduit member that can be configured to facilitate the flow of dirty air. Preferably, the downflow conduit includes a flexible conduit member (e.g. a flexible hose). Providing a flexible conduit member may help facilitate removal and manipulation of the cleaning wand 154. In the illustrated example, the downflow conduit 188 includes a flexible hose. Preferably, the hose is at least somewhat extensible so that it can be stretched to provide some extra length when the cleaning wand 154 is in use, and can retract to a shorter length when the cleaning wand 154 is mounted on the cleaning unit 108.

Optionally, when the cleaning wand 154 is detached from the cleaning unit 108, the connection between the downstream end 196 of the hose 188 and the upstream end 198 of the second upflow conduit 186 may provide the only mechanical and/or structural connection between the cleaning wand 154, handle 118 and flexible hose 188 and the cleaning unit 108. In this configuration, manipulation of the cleaning wand 154 may exert a pulling force on the hose 188. This pulling or tension force may be transferred to the surface cleaning apparatus 100 via the connection between the downstream end 196 of the downflow duct 188 and the cleaning unit 108.

For example, a user manipulating the cleaning wand 154 may attempt to reach a distant location and may pull on the hose 188 to provide additional reach. This force may be transferred via the hose 188 to the cleaning unit 108. Preferably, such forces may cause the surface cleaning apparatus 100 to move toward the user, and more preferably the surface cleaning apparatus 100 will remain upright during such moves. This may allow the surface cleaning apparatus 100 to generally follow the user across a surface, similar to the behavior of a canister used in a canister-type vacuum cleaner. Preferably, the surface cleaning apparatus 100 can be configured to be relatively stable when subjected to such pulling forces so that the surface cleaning apparatus 100 will tend to move toward the user, instead of tipping over. More preferably, the surface cleaning apparatus 100 can be configured to be generally stable when the cleaning unit 108 is mounted on the surface cleaning head 102, and also when the cleaning unit 108 is detached from the surface cleaning head 102, for example if the cleaning unit 108 is placed on the floor.

Positioning the attachment point 212 between the flexible hose 188 and the cleaning unit 108 (see for example FIGS. 2, 6, and 11) in a relatively low position/location on the upper section 104, for example in the illustrated example on the cleaning unit 108, may be one configuration that help improve the stability of the surface cleaning apparatus 100 when subjected to pulling forces via the flexible hose 188.

However, it may also be desirable that the surface cleaning apparatus 100 be configured so that the air treatment member 110, and optionally its air inlet 180, be provided toward the top of the cleaning unit 108. This may allow a user to more easily see and access the air treatment member 110 without having to bend over too much, etc.

Configuring the second upflow conduit 186 to extend generally upwards (either vertically or at an inclined angle) from the connection point 212 of the flexible hose 188 on the cleaning unit 108 may help accommodate a relatively low connection point 212 between the flexible hose 188 and the cleaning unit 108 while simultaneously providing a downstream end 200 of the second upflow conduit 186 that can be provided in an upper portion of the cleaning unit 108 so that it can be coupled to the air treatment member 110.

Preferably, the second upflow conduit 186 is configured so that when the cleaning unit 108 is mounted on the surface cleaning head 102 and is positioned in the generally upright position (as illustrated in FIG. 3) the upstream end 198 of the upflow conduit 186 is positioned at or below the center of gravity 214 of the surface cleaning apparatus 100 (see also FIG. 8). Optionally, for example to help accommodate a desired placement of the air treatment member 110, the downstream end 200 of the upflow conduit 86 may be spaced above the upstream end 198 of the second upflow conduit 186 and may be positioned at or above the center of gravity 214 of the surface cleaning apparatus 100. In this configuration, the second upflow conduit 186 extends across the center of gravity 214 of the surface cleaning apparatus 100. In this configuration, the connection between the flexible hose 188 and the upper section 104 is disposed below the center of gravity 214 of the surface cleaning unit 100.

More preferably, the upstream end 198 of the second upflow conduit 186 is provided in a lower portion of upper section 104, for example toward the bottom of the cleaning unit 108, and/or below at least some of the other operating components provided in the upper section, and the downstream end 190 of the second upflow conduit 186 is positioned in an upper portion of the upper section 108. Most preferably, the upstream end 198 of the second upflow conduit 186 is provided at or toward the bottom end of the upper section 104 (e.g. the bottom of the cleaning unit 108). Alternatively, the upstream end of the second upflow conduit can be provided at any other suitable location.

Removing the upper section 104, including cleaning unit 108, from the surface cleaning apparatus 100 may alter the center of gravity of the surface cleaning apparatus. When the upper section 104 is detached, it may have its own center of gravity 216, as exemplified in FIG. 8. Preferably, the upstream end 198 of the second upflow 186 conduit is positioned on the upper section 104 (e.g. on the cleaning unit 108) such that the upstream end 198 is located at or below the center of gravity 216 of the upper section 104. In this configuration, the downstream end 200 of the second upflow conduit 186 may be positioned above the center of gravity 216 of the upper section 106.

In the illustrated example, the center of gravity 216 of the upper section 104 is located outside and below the cyclone bin assembly 110. In this configuration, the upstream end 198 of the second upflow conduit 186 is positioned below the cyclone chamber 158 and the floor 218 of the dirt collection chamber 160 within the cyclone bin assembly 110 (see also FIG. 5).1

Referring to FIG. 8, in the illustrated example, the distance 220 between the generally horizontal plane 166 containing the bottom of the cleaning unit 108 and the upstream end 198 of the second upflow duct 186 (measured to the geometric centerline of the conduit) is less than the distances 222 and 224 between the plane 166 and the centers of gravity 214 and 216, respectively. Optionally, the distance 220 can be between about 15% and about 45% of distance 222 and/or distance 224. Alternatively, the upstream end 198 of the second upflow conduit 186 may be positioned at the same height as at least a portion of the dirt collection chamber 160 and/or the cyclone chamber 158.

Optionally, the downstream end 200 of the second upflow conduit 186 may be generally adjacent the air inlet 180 of the air treatment member 110. Preferably, the downstream end 200 can be coupled directly to the air inlet 180, as illustrated in FIG. 8. Any suitable seal or other connection mechanism may be provided at the interface. In this configuration, the downstream end 200 of the second upflow conduit 186 is positioned between the floor 218 of the dirt collection chamber 160 and the upper endwall of the cyclone chamber 158, which in the present example is provided by the underside of the lid 174. In the illustrated example, the spacing 226 between the plane 166 and the downstream end 200 of the second upflow conduit 186 is about the same as the spacing between the plane 166 and the air inlet. Alternatively, instead of a direct connection, a separate connector or conduit section may be provided between the downstream end 200 of the second upflow conduit 186 and the air inlet 180. In this configuration, the spacings 226 and 228 need not be equal.

In some configurations, the suction motor may be one of the heavier components on the upper section 104. In FIG. 8 a schematic representation of a suction motor 228 is shown in phantom. The center of gravity 230 of the suction motor 228 may, or may not, coincide with the center of gravity 216 of the upper section. Optionally, the upper section 104 can be configured so that the upstream end 198 of the second upflow conduit 86 is provided below the center of gravity 230 of the suction motor 228, so that the spacing 220 is less than the spacing 232 between plane and the center of gravity of the suction motor. Optionally, the distance 220 can be between about 5% and about 100% or greater than 100% of the distance 232 (e.g. in some configurations the upstream end 198 may be at the same height as the center of gravity 230 or positioned above the center of gravity 230). Preferably, the upstream end 198 of the second upflow conduit 186 may be positioned below the suction motor 228 and the downstream end 200 of the second upflow conduit 186 may be positioned above the suction motor 228.

The spacing 234 between the upstream and downstream ends 198 and 200 of the second upflow conduit 186, measured along a longitudinal axis 236 that is generally orthogonal to plane 166, defines a longitudinal upflow conduit height 234. The upflow conduit height 234 may be selected based on a plurality of factors, including the position of one or more centers of gravity 214, 216 and/or 230 and/or other operating components of the surface cleaning apparatus 100. In the illustrated examples, the cleaning unit height 162 and an upper section height 231 (FIG. 3) are also measured along axis 236. Optionally, in some configurations, the cleaning unit height 162 may be generally equal to the upper section height 231.

Preferably, the upflow conduit height 234 may be at least about 35% of the cleaning unit height 162, and may be between about 35% and about 85% of the cleaning unit height 162. Optionally, the upflow conduit height 234 may be at least 50% of the cleaning unit height 162 and preferably may be between about 60% and about 75% of the cleaning unit height 162, and may be about 65% of the cleaning unit height 162.

Optionally, the upper section 104 may be configured so that the upflow conduit height 234 is at least about 15% and may be between about 15% and about 60% of the upper section height 231. Preferably, the upflow conduit height 234 may be between about 20% and about 40% of the upper section height 231, and may be about 25% of the upper section height 231.

Optionally, the upstream end 198 of the second upflow conduit 186 can be positioned proximate the lower end of the cleaning unit 108 so that the spacing 220 between the upstream end 198 and the plane 166 is less than about 25% of the surface cleaning unit height 162, and may be less than about 15% or less than about 10% the cleaning unit height 162. In this configuration, the spacing 220 may be less than 10%, and may be less than about 5% of upper section height 231.

The distance along the length of the air flow passage 116 extending between the upstream and downstream ends 198 and 200 of the second upflow conduit 186 defines a conduit length 240 (FIG. 3). The upflow conduit length 240 can be selected to be any suitable length. Similarly, the distance 242 (FIG. 11) between the inlet and outlet of the above floor cleaning wand 154 may define a wand length 242 and the distance 244 between the upstream end 194 of the downflow conduit 188 and the downstream end 196 of the downflow conduit 188, when the wand 154 is connected to the cleaning unit as illustrated in FIG. 2 (with a portion of the hose 188 removed), defines a downflow conduit length 244. Optionally, the upflow conduit length 240 can be selected so that it is at least 35% of the wand length 242 and/or downflow conduit length 244 and is between about 50% and about 85% of the wand length 242 and/or downflow conduit length 244. Preferably, the upflow conduit length 240 can be selected so that it is between about 40% and about 50% of the of the wand length 242 and/or downflow conduit length 244. Optionally, the length 240 may be greater than the height 111 of the cyclone bin assembly 110 (e.g. the distance between the upper end wall of the cyclone chamber 158 and the floor 218 of the dirt collection chamber 160).

Preferably, the connection 212 between the flexible hose 188 and the second upflow conduit 186 is a moveable and/or rotatable connection. Allowing relative rotation between the downstream end 196 of the hose 188 and the upstream end 198 of the second upflow conduit 186 may help reduce torques and other rotational forces exerted on the cleaning unit 108, and may help prevent twisting of or other damage to the flexible hose 188. The rotatable connection can be provided using any suitable coupling mechanism.

Optionally, as exemplified in FIG. 6, a conduit member, such as a curved elbow connector 246, can be provided between the flexible hose 188 and the upflow conduit 186. Preferably, the elbow connector 246 is rotatably coupled to at least one of the downstream end 196 of the flexible hose 188 and/or the upstream end 198 of the second upflow conduit 186. This may provide a first degree of freedom. More preferably, the elbow connector 246 may be rotatably coupled to both the upstream end 198 of the second upflow conduit 186 and the downstream end 196 of the downflow conduit 188.

Preferably, the coupling 248*a* at the first end, or inlet, of the elbow connector 246 is rotatable about a first axis of rotation 250*a* and coupling 248*b* at the second end, or outlet, of the elbow connector 246 is rotatable about a respective second axis of rotation 250*b*. Optionally, the second axis 250*b* may be at an angle 252 relative to the first axis 250*a*, and may be oriented generally orthogonal to the first axis. In this configuration, the first end of the elbow connector and second end of the elbow connector are oriented in different directions. This may provide an additional degree of freedom at the joint 212.

Optionally, the connection 212 between the upper section 104 and the downflow conduit 188 may be provided at any desired location on the upper section 104, and is preferably positioned toward the back, or on the back of the upper section 104 (relative to the direction of motion of the surface cleaning apparatus). The air inlet 180 of the air treatment member 110 may be provided at any suitable location on the air treatment member 110. In some configurations, the air treatment member 110 may be provided on the side of the cleaning unit 108, and may be spaced apart from the back of the upper section 104 and may be spaced apart forward from the connection 212 between the upper section 104 and the downflow conduit 188.

The upflow conduit 186 may be of any suitable shape and configuration to extend between the connection 212 between the upper section 104 and the downflow conduit 188 and the air inlet 180. That is, the upstream and downstream ends 198 and 200 of the second upflow conduit 186 may be spaced apart from each other in the forward-backward direction. In the illustrated example, the second upflow conduit 186 is a generally linear conduit, extending along conduit axis 252, that is inclined at an angle 254, relative to a horizontal plane 166 (FIG. 8), and extends upwardly and forwardly from its upstream end 198. The angle 254 may be selected based on the configuration of the upper section 104. Alternatively, the upflow conduit 186 may be non-linear and may be curved of have any other suitable configuration, and may not be inclined.

Alternatively or in addition, the upstream and downstream ends 198 and 200 of the second upflow conduit 186 may be spaced apart from each other in the lateral, e.g. side to side, direction.

Optionally, in some configurations, the second upflow conduit may be a generally vertical conduit, and the downstream end of the second upflow conduit may be positioned vertically above and may partially, or totally overlie the upstream end when the upper section is in the upright position.

Referring to FIGS. 1 and 11, the handle 118 on the upper section 104 may be any suitable type of handle that can be gripped by a user.

Optionally, the handle 118 can be grippable in more than one direction. This may allow the user to grip the handle in one direction when operating the surface cleaning apparatus in surface cleaning mode (for example FIG. 1), and in a second direction when operating the surface cleaning apparatus in the auxiliary cleaning mode (for example FIGS. 11 and 12). This configuration may allow a user to comfortably operate the surface cleaning apparatus 100 in both operating modes. It may also give the user increased freedom when operating in the auxiliary cleaning mode, as the user may orient the handle 118, and cleaning wand 154 extending therefrom, in multiple orientations relative to the user's arm.

As exemplified in FIGS. 8 and 11, preferably, the handle 118 may include at least two separate grip members 260 and 262 that are spaced apart from each other to help provide at least two discrete grippable locations. Optionally, the handle 118 may include an outer (or optionally internal) support member 264 and the grip members 260 and 262 may be provided on the outer support member 264.

The grip members 260 and 262 may be formed from any suitable material, including relatively soft foam-like or gel-like materials that may help improve user comfort. Optionally, the grip members 260 and 262 may be integrally formed with the outer support member 264. Alternatively, the grip members 260 and 262 may be provided as separate members that can be coupled to the outer support using any suitable fasteners, including, for example, screws.

Optionally, the grip members 260 and 262 may be integrally formed with each other as part of a continuous insert member 266 that can be coupled to the outer support member 264.

Preferably, the first grip member 260 may be generally linear and may be oriented in a first direction, along a first grip axis 268. The second grip member 262 may also optionally be generally linear and may be oriented in a different, second direction along a second grip axis 270. Optionally, the angle 272 between the first and second grip members may be between about 10 and about 175 degrees, and may be between about 85 and about 120 degrees.

Optionally, the handle 118 may include more than two grip members. For example a third grip member may be provided on the handle and may extend along a third axis.

In the illustrated example, when the surface cleaning apparatus is in the upright position, the second grip member 262 is in a generally upright position (e.g. within about 10 degrees of vertical) and the first grip member 260 is at an angle 274 to a horizontal plane. Preferably, the angle 274 may be between about 0 and about 30. Preferably, the second grip 262 is positioned so that it is provided toward the front of the handle 118 and the first grip 260 is provided toward the top of the handle 118.

Alternatively, the second grip may be provided toward the back of the handle or at another suitable position.

While illustrated as forming part of the air flow passage, the surface cleaning apparatus may include a handle that is separate from the air flow passage. For example, a handle shaft may extend from the cleaning unit and may be provided adjacent, and generally parallel to the cleaning wand.

Referring to FIGS. 13-20, another embodiment of a surface cleaning apparatus 1100 includes a surface cleaning head 1102 and an upper section 1104. The upper section 1104 includes a cleaning unit 1108 that has an air treatment member 110 and suction motor housing 112. Features of the surface cleaning apparatus 1100 that are analogous to features of the surface cleaning apparatus 100 are represented by like reference characters, indexed by 1000.

In the illustrated example, surface cleaning apparatus 1100 includes an air flow 1116 passage that extends between the dirty air inlet 2106 on the surface cleaning head 2102 and the clean air outlet 2114 on the upper section 2104. In this example, the air flow passage 2116 is not centered on the upper section 2104, and instead includes conduits that are laterally spaced apart from the centerline 1300 (FIG. 16) of the surface cleaning apparatus 1100. The air flow passage 2116 includes a first upflow conduit 1184, a downflow conduit 1188 and a second outflow conduit 1186.

Further, in this example the handle 1118 that is drivingly connected to the upper section 1104 includes a handle shaft portion 1302 extending between the grip portion and the cleaning unit 1108. The handle shaft 1302 need not be a hollow conduit member, and it need not form part of the air flow passage 1116. In the illustrated configuration, the handle 1118 is separate from the air flow passage 1116.

Figure 15:
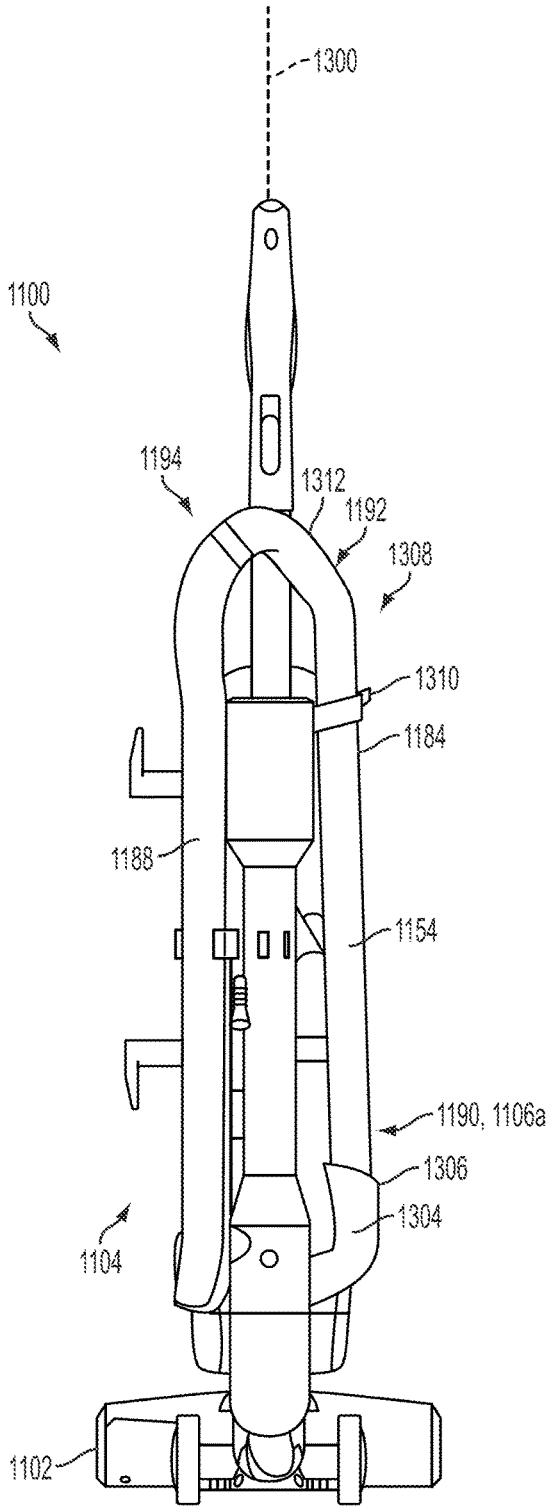
FIG. 15 is a back view of the surface cleaning apparatus of FIG. 13.
Figure 17:
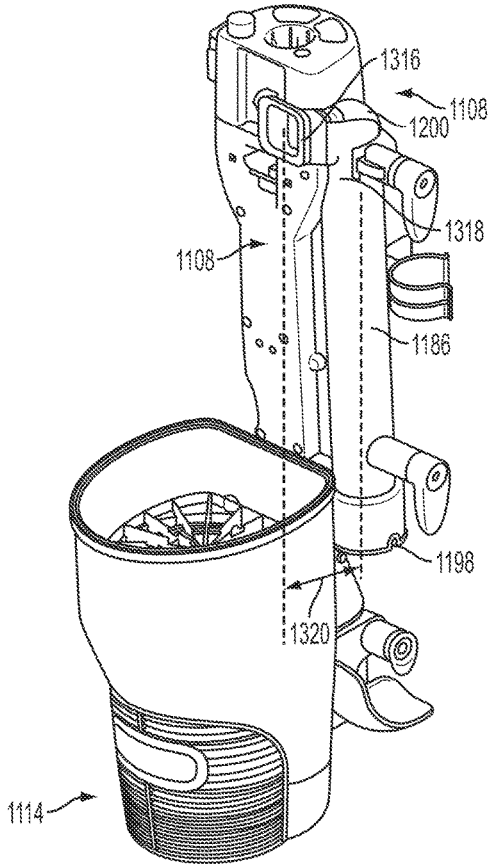
FIG. 17 is a front perspective view of a portion of the surface cleaning apparatus of FIG. 13.
Figure 16:
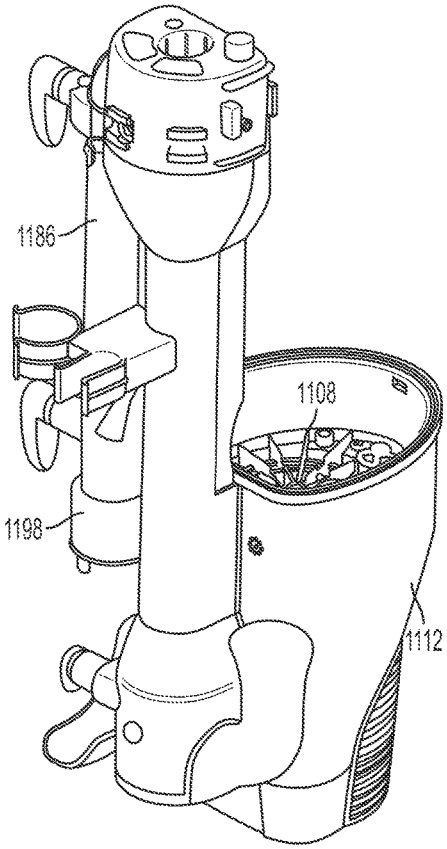
FIG. 16 is a rear perspective view of a portion of the surface cleaning apparatus of FIG. 13.
Figure 19:
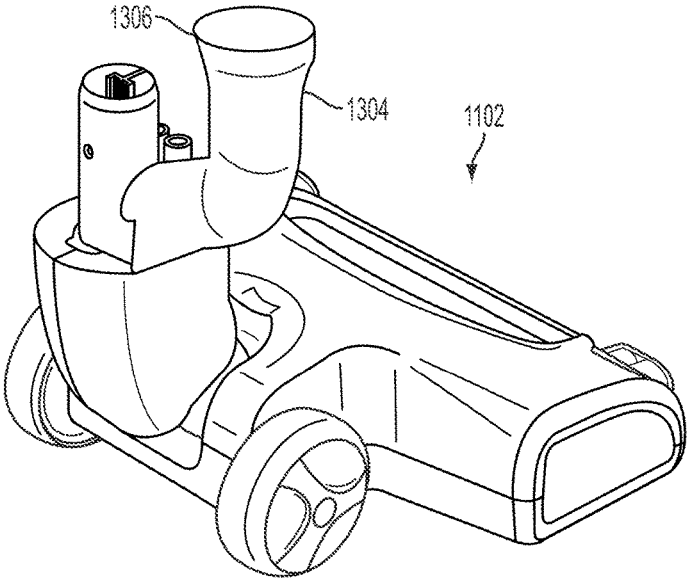
FIG. 19 is a front perspective view of a portion of the surface cleaning apparatus of FIG. 13.
Figure 18:
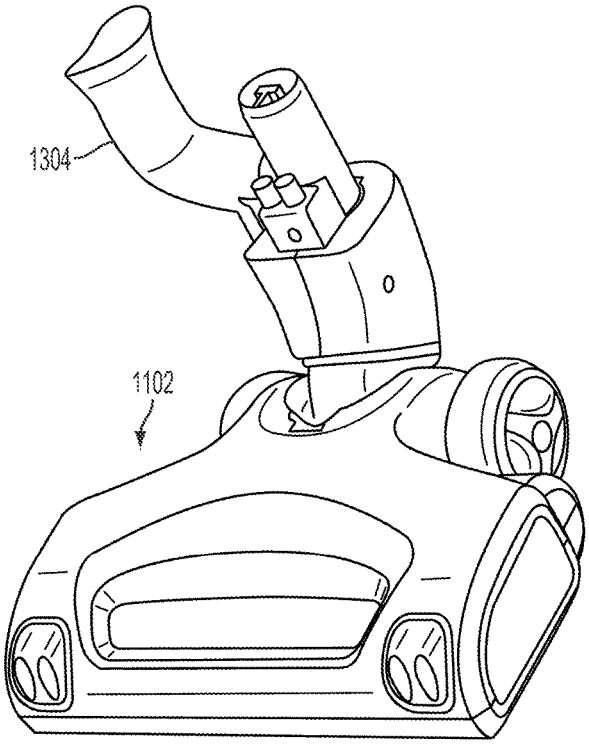
FIG. 18 is a rear perspective view of a portion of the surface cleaning apparatus of FIG. 13.

In this example, the first upflow conduit 1184 has an upstream end 1190 that can be connected in air flow communication with the surface cleaning head 1102, via a curved conduit member 1304 (FIGS. 15, 18 and 19). The conduit member 1304 may be provided on the upper section, or as illustrated, may form part of the surface cleaning head 1102. In the illustrated example, the curved conduit member 1304 is provided on the surface cleaning head 1102.

Optionally the air flow passage 1116 can be re-configurable so that the surface cleaning apparatus 1100 can be configured in at least two different operating modes. In the illustrated example, at least a portion of the first upflow conduit 1184 may be operable as a cleaning wand 1154 that can be selectably detached from the upper section 1104 to re-configure the air flow passage 1116 so that the surface cleaning apparatus 1100 can be operated in an auxiliary, above floor cleaning mode. The cleaning wand 1154 may have an inlet 1106*a* that is releasably attached to the downstream end 1306 of the curved conduit member 1304. An upper portion 1308 of the cleaning wand 1154 may be releasably retained in any suitable mechanism, including, for example a clip 1310.

A downstream or outlet end 1192 of the cleaning wand 1154 can be connected to the upstream end 1194 of a flexible, downflow conduit 1188 by any suitable coupling conduit section 1312. Preferably, the coupling conduit 1312 can be a generally rigid conduit member that is configured to be graspable by a user. When the cleaning wand 1154 is detached from the upper section 1104, the coupling conduit 1312 may serve as a handle or grip member to allow a user to grasp and manipulate the cleaning wand 1154. Optionally, the connection between the coupling conduit 1312 and the cleaning wand 1154, and/or the connection between the coupling conduit 1312 and the downflow conduit 1188 may be rotatable and/or detachable. This may help facilitate movement of the cleaning wand 1154 relative to the cleaning unit 1108 when the cleaning wand 1154 is detached.

Preferably, the downflow conduit 1188 is a flexible hose member. In the illustrated example, the downstream end 1196 of the hose is coupled to the upstream end 1198 of the second upflow conduit 1186. The coupling 1212 between the hose 1188 and the second upflow conduit 1186 may be any suitable coupling, and may be rotatable and/or detachable.

In the illustrated example, the second upflow conduit 1186 is a generally vertical conduit member in which the downstream end 1200 of the conduit is positioned above the upstream end 1198. The downstream end 1200 includes an outlet 1316 extending forward from the conduit wall 1318 that can be coupled to the air inlet 1180 of the cyclone bin assembly 1110. Preferably, the connection between the downstream end 1200 and the air inlet 1180 is releasable so the cyclone bin assembly 1110 can be removed for emptying; In this configuration, the outlet end 1200 of the second upflow conduit 1186 is located forward of the upstream end 1198 by a relatively small distance 1320.

In this configuration, the longitudinal spacing 1234, parallel to longitudinal axis 1236 between the upstream and downstream ends 1198 and 1200 of the second upflow conduit 1186 is between about 35% and about 75% of the cleaning unit height 1162, and may be between about 45% and 55% of the cleaning unit height 1162. The longitudinal spacing 1234 may also be between about 15% and about 50%, and between about 20% and about 30% of the surface cleaning apparatus height 2120. Preferably, the longitudinal spacing 1234 may be about 25% of the surface cleaning apparatus height.

In the illustrated example, the upstream end 1198 of the second upflow conduit 1186 may be positioned below the center of gravity 1214 of the surface cleaning apparatus, and above the center of gravity of the cleaning unit 1216 when the upper section is in the upright position. In this configuration, the upstream end 1198 of the second upflow conduit 1186 is positioned below the air treatment member 1110 (e.g. below the floor 1218 of the dirt collection chamber 1160) and the downstream end 1200 of the second upflow conduit 1186 is provided toward the top of the cyclone bin assembly 1110. Optionally, the length 1240 (which in the illustrated example is generally equal to the height 1234) of the second upflow conduit 1186 may be greater than the height 1111 of the cyclone bin assembly 1110.

It will be appreciated that, depending upon the aspects that are incorporated into a surface cleaning apparatus, some of the exemplified features may not be used or may be varied so as to be of any design known in the art.

What has been described above has been intended to be illustrative of the invention and non-limiting and it will be understood by persons skilled in the art that other variants and modifications may be made without departing from the scope of the invention as defined in the claims appended hereto.

The invention claimed is:

1. An upright surface cleaning apparatus comprising:

(a) a surface cleaning head having a dirty air inlet;

(b) an air flow passage extending from the dirty air inlet to a clean air outlet and comprising a flexible conduit section;

(c) an upper section movably mounted to the cleaning head and moveable between a upright position and a second inclined in use position and comprising (d) an air treatment member positioned in the air flow passage between the dirty air inlet and the clean air outlet;

(e) a suction motor positioned in the air flow passage; and, (f) the upper section further comprising an upflow conduit positioned in the air flow passage between the flexible conduit section and the air treatment member and, when the upper section is in the upright position, the flexible conduit comprises a portion that extends downwardly to a downstream end of the flexible conduit and the upflow conduit extends upwardly from an upstream end of the upflow conduit to a downstream end of the upflow conduit, wherein, when the upper section is in the upright position, at least a portion of the upflow conduit is positioned below a center of gravity of the upright surface cleaning apparatus.

2. The surface cleaning apparatus of claim 1, wherein when the upper section is in the upright position the upstream end of the upflow conduit is positioned below the center of gravity of the surface cleaning apparatus and the downstream end of the upflow conduit is above the center of gravity of the surface cleaning apparatus.

3. The surface cleaning apparatus of claim 1, wherein the upstream end of the upflow conduit is at a level with the suction motor, and the suction motor is disposed below the air treatment member at a lower end of the upright section.

4. The surface cleaning apparatus of claim 1, wherein the air treatment member comprises an air inlet and when the upper section is in the upright position the upstream end of the upflow conduit is below the air inlet of the cyclone chamber.

5. The surface cleaning apparatus of claim 4, wherein the downstream end of the rigid upflow conduit comprises a handle drivingly connected to the upper section.

6. The surface cleaning apparatus of claim 1, further comprising a rigid upflow conduit extending upwardly from an upstream end connected in air flow communication with the surface cleaning head to a downstream end positioned above the air treatment member when the upper section is in the upright position, and the flexible conduit section positioned between the downstream end of the rigid upflow conduit and the upstream end of the upflow conduit.

7. The surface cleaning apparatus of claim 1, wherein the air treatment member comprises a cyclone chamber and a dirt collection chamber disposed at least partially below the cyclone chamber to receive dirt from the cyclone chamber, the dirt collection chamber having a bottom end wall and the upstream end of the upflow conduit is below the bottom end wall of the dirt collection chamber when the upper section is in the upright position.

8. The surface cleaning apparatus of claim 1, wherein the upper section comprises a cleaning unit and the cleaning unit comprises at least the air treatment member.

9. The surface cleaning apparatus of claim 8, wherein the cleaning unit has a cleaning unit height measured in the direction of a longitudinal cleaning unit axis and a longitudinal spacing between the upstream end of the upflow conduit and the downstream end of the upflow conduit is between about 15% and about 100% of the upper section unit height.

10. The surface cleaning apparatus of claim 9, wherein the longitudinal spacing between the upstream end of the upflow conduit and the downstream end of the upflow conduit is between about 35% and about 85% of the upper section unit height.

11. The surface cleaning apparatus of claim 9, wherein a longitudinal spacing between the upstream end of the upflow conduit and the bottom of the cleaning unit is less than about 25% of the upper section unit height.

12. The surface cleaning apparatus of claim 9, wherein the longitudinal spacing between the upstream end of the upflow conduit and the bottom of the cleaning unit is less than about 10% of the upper section height.

13. The surface cleaning apparatus of claim 1, further comprising an above floor cleaning wand, the surface cleaning apparatus is operable in a floor cleaning mode wherein the above floor cleaning wand forms a portion of the air flow passage and an above floor cleaning mode wherein an inlet of the above floor cleaning wand is detached from air flow communication with the dirty air inlet, and the above floor cleaning wand has an outlet connected upstream from the flexible conduit section.

14. The surface cleaning apparatus of claim 13, wherein the cleaning wand has a wand length, the upflow conduit has an upflow conduit length and the upflow conduit length is at least 35% of the wand length.

15. The surface cleaning apparatus of claim 13, when the cleaning wand is attached to the upper section and when the upper section is in the upright position, the inlet of the cleaning wand is positioned vertically between the upstream end and downstream end of the upflow conduit.

16. An upright surface cleaning apparatus comprising:

(a) a surface cleaning head having a dirty air inlet;

(b) an air flow passage extending from the dirty air inlet to a clean air outlet;

(c) an upper section movably mounted to the surface cleaning head and moveable between an upright position and a second inclined in use position, the upper section comprising (d) an air treatment member positioned in the air flow passage between the dirty air inlet and the clean air outlet; and, (e) a suction motor positioned in the air flow passage;

(f) wherein, when the upper section is in the upright position, the air flow passage comprises:

(i) a rigid first upflow conduit extending between an upstream end of the rigid first upflow conduit that is in fluid flow communication with the surface cleaning head and a downstream end of the rigid first upflow conduit that is positioned above the air treatment member;

(ii) a second upflow conduit extending upwardly from an upstream end of the second upflow conduit that is positioned proximate a lower end of the upper section to a downstream end of the second upflow conduit that is positioned above the upstream end of the second upflow conduit;

and, (iii) a downflow conduit extending between the downstream end of the first upflow conduit and the upstream end of the second upflow conduit.

17. The surface cleaning apparatus of claim 16, wherein the air treatment member comprises an air inlet and when the upper section is in the upright position the upstream end of the second upflow conduit is below the air inlet of the cyclone chamber.

18. The surface cleaning apparatus of claim 16, wherein the upper section has an upper section height measured in the direction of a longitudinal cleaning unit axis and a longitudinal spacing between the upstream end of the second upflow conduit and the downstream end of the second upflow conduit is between about 15% and about 100% of the upper section height.

19. The surface cleaning apparatus of claim 18, wherein the longitudinal spacing between the upstream end of the second upflow conduit and the downstream end of the second upflow conduit is between about 25% and about 85% of the upper section height.

20. The surface cleaning apparatus of claim 18, wherein a longitudinal spacing between the upstream end of the second upflow conduit and the bottom of the cleaning unit is less than about 25% of a cleaning unit height.

21. The surface cleaning apparatus of claim 16, further comprising an above floor cleaning wand, the surface cleaning apparatus is operable in a floor cleaning mode wherein the above floor cleaning wand forms a portion of the air flow passage and an above floor cleaning mode wherein an inlet of the above floor cleaning wand is detached from air flow communication with the dirty air inlet, and the above floor cleaning wand has an outlet connected upstream from the flexible conduit section.

* * * * *